US008998362B2

(12) United States Patent
Ito

(10) Patent No.: US 8,998,362 B2
(45) Date of Patent: Apr. 7, 2015

(54) LIQUID EJECTION APPARATUS

(75) Inventor: Yuichi Ito, Mie-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 250 days.

(21) Appl. No.: 13/362,400

(22) Filed: Jan. 31, 2012

(65) Prior Publication Data

US 2012/0236056 A1 Sep. 20, 2012

(30) Foreign Application Priority Data

Mar. 15, 2011 (JP) ..... 2011-056864
Mar. 15, 2011 (JP) ..... 2011-057016

(51) Int. Cl.

| | |
|---|---|
| ***B41J 29/38*** | (2006.01) |
| ***B41J 2/155*** | (2006.01) |
| ***B41J 2/045*** | (2006.01) |
| ***B41J 2/14*** | (2006.01) |
| ***B41J 2/165*** | (2006.01) |

(52) U.S. Cl.

CPC ..... *B41J 2/155* (2013.01); *B41J 2/04536* (2013.01); *B41J 2/04566* (2013.01); *B41J 2/04581* (2013.01); *B41J 2/14233* (2013.01); *B41J 2/16526* (2013.01); *B41J 2/16585* (2013.01); *B41J 2002/14266* (2013.01); *B41J 2002/14459* (2013.01); *B41J 2202/20* (2013.01)

(58) Field of Classification Search

CPC ..... B41J 2/16526
USPC ..... 347/14
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 6,166,828 | A * | 12/2000 | Yamada et al. | 358/1.8 |
| 6,450,632 | B1 * | 9/2002 | Tsang et al. | 347/96 |
| 2002/0101472 | A1 | 8/2002 | Tsuboi et al. | |

(Continued)

FOREIGN PATENT DOCUMENTS

| | | | |
|---|---|---|---|
| EP | 0704307 | A2 | 4/1996 |
| JP | 2002-144599 | A | 5/2002 |

(Continued)

OTHER PUBLICATIONS

English machine translation of JP 2008-080740.*

(Continued)

*Primary Examiner* — Manish S Shah
*Assistant Examiner* — Jeffrey C Morgan
(74) *Attorney, Agent, or Firm* — Baker Botts L.L.P.

(57) ABSTRACT

A liquid ejection apparatus comprises a head, a conveyor, an image dot controller, a determiner and a non-image dot controller. The determiner determines whether an image dot non-forming period is equal to or longer than a predetermined time period. The non-image dot controller controls the head so that each ejection opening, whose image dot non-forming period is equal to or longer than the predetermined time period, ejects liquid once within a non-image dot forming period in the image dot non-forming period, to form on a recording medium a non-image dot, the non-image dot forming period being a period from a third time point which is after the first time point to a second time point which is the predetermined time period after the first time point, and that a plurality of the non-image dots structured by the liquid ejected from the ejection openings are scattered in a conveyance direction.

21 Claims, 13 Drawing Sheets

(56) References Cited

U.S. PATENT DOCUMENTS

| | | | | |
|---|---|---|---|---|
| 2006/0055715 | A1 | 3/2006 | Nakahara et al. | |
| 2006/0061617 | A1* | 3/2006 | Udagawa | 347/23 |
| 2006/0109300 | A1* | 5/2006 | Tsuboi et al. | 347/23 |
| 2006/0187257 | A1* | 8/2006 | Ito | 347/35 |
| 2006/0197795 | A1 | 9/2006 | Takatsuka et al. | |
| 2010/0245919 | A1 | 9/2010 | Kanzaki | |
| 2011/0050768 | A1 | 3/2011 | Itogawa | |

FOREIGN PATENT DOCUMENTS

| | | | |
|---|---|---|---|
| JP | 2005-225115 | A | 8/2005 |
| JP | 2006-076247 | A | 3/2006 |
| JP | 2006-272963 | A | 10/2006 |
| JP | 2006-297666 | A | 11/2006 |
| JP | 2008-018569 | A | 1/2008 |
| JP | 2008-080740 | A | 4/2008 |
| JP | 2009-255480 | A | 11/2009 |
| JP | 2011-025480 | A | 2/2011 |
| JP | 2011-046068 | A | 3/2011 |

OTHER PUBLICATIONS

Japan Patent Office, Notification of Reasons for Rejection for Japanese Patent Application No. 2011-057016 (counterpart Japanese patent application), mailed on Mar. 26, 2013.

European Patent Office, extended European Search Report for European Patent Application No. 12152990.3 (counterpart European patent Application), dated Jul. 2, 2012.

Japan Patent Office, Notice of Reasons for Rejection for Japanese Patent Application No. 2011-056864 (counterpart to above-captioned patent application), mailed Dec. 10, 2014.

* cited by examiner

LIQUID EJECTION APPARATUS

CROSS REFERENCE TO RELATED APPLICATION

This application claims priority from Japanese Patent Applications No. 2011-057016 and No. 2011-056864, which were filed on Mar. 15, 2011, the disclosure of which is herein incorporated by reference in its entirety.

BACKGROUND OF THE INVENTION

1. Field of the Invention

The present invention relates to a liquid ejection apparatus capable of ejecting liquid such as ink.

2. Description of Related Art

As a technology of liquid ejection apparatuses, there has been known a technology which analyzes compressed image data, and when the size of a blank data area indicative of an area with no image to be formed is a prescribed size or larger, setting that area as an area for performing pre-ejection to recover ejection performance.

SUMMARY OF THE INVENTION

However, if no appropriate adjustment is done as to where and how to form non-image dots which are not related to image formation, the above technology may lead to deterioration of image quality, due to a loss in the sharpness of an image, or the non-image dots being noticeable.

It is therefore an object of the present invention to provide a liquid ejection apparatus capable of forming non-image dots while restraining deterioration of the image quality.

In a first aspect of the present invention, there is provided a liquid ejection apparatus, comprising a head, a conveyor, an image dot controller, a determiner and a non-image dot controller. The head has a plurality of ejection openings for ejecting liquid, the ejection openings being arranged at equal intervals relative to one direction. The conveyor conveys a recording medium relatively to the head, in a conveyance direction intersecting the one direction. The image dot controller controls the head based on image data so that the liquid is ejected from the ejection openings to form image dots structuring pixels of an image on the recording medium conveyed by the conveyor. The determiner successively determines, for each of the ejection openings, whether an image dot non-forming period is equal to or longer than a predetermined time period, the image dot non-forming period being a period from a first time point where an image dot is formed to another time point where a subsequent image dot is formed under control by the image dot controller. The non-image dot controller controls the head so that each of the ejection openings, whose image dot non-forming period is equal to or longer than the predetermined time period, ejects the liquid once within a non-image dot forming period in the image dot non-forming period, to form on the recording medium a non-image dot which is not based on the image data, the non-image dot forming period being a period from a third time point which is after the first time point to a second time point which is the predetermined time period after the first time point, and that a plurality of the non-image dots structured by the liquid ejected from the ejection openings are scattered in the conveyance direction.

In a second aspect of the present invention, there is provided a liquid ejection apparatus, comprising a head, a conveyor, an image dot controller, a determiner and a non-image dot controller. The head has a plurality of ejection openings for ejecting liquid, the ejection openings being arranged at equal intervals relative to one direction. The conveyor conveys a recording medium relatively to the head, in a conveyance direction intersecting the one direction. The image dot controller controls the head based on image data so that the liquid is ejected from the ejection openings to form image dots structuring pixels of an image on the recording medium conveyed by the conveyor. The determiner successively determines, for each of the ejection openings, whether a non-ejection period is equal to or longer than a predetermined time period, the non-ejection period being a period from a first time point where the liquid is ejected from the ejection opening to another time point where subsequent ejection of the liquid from the ejection opening occurs under control by the image dot controller. The non-image dot controller controls the head so that each of the ejection openings, whose non-ejection period is equal to or longer than the predetermined time period, ejects the liquid once within a time period ranging from the first time point to a second time point which is the predetermined time period after the first time point, the time period being in a beginning section subsequent to the first time point in the non-ejection period, and that the shorter the period elapsed from the first time point, the smaller the at least one of the probability of ejecting liquid from the ejection opening and the amount of liquid ejected from the ejection opening becomes.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes, with reference to the attached drawings, a preferable embodiment of the present invention.

First, with reference to FIG. 1 to FIG. 10, the following describes an ink-jet printer 101 related to a first embodiment of the present invention.

Figure 1:
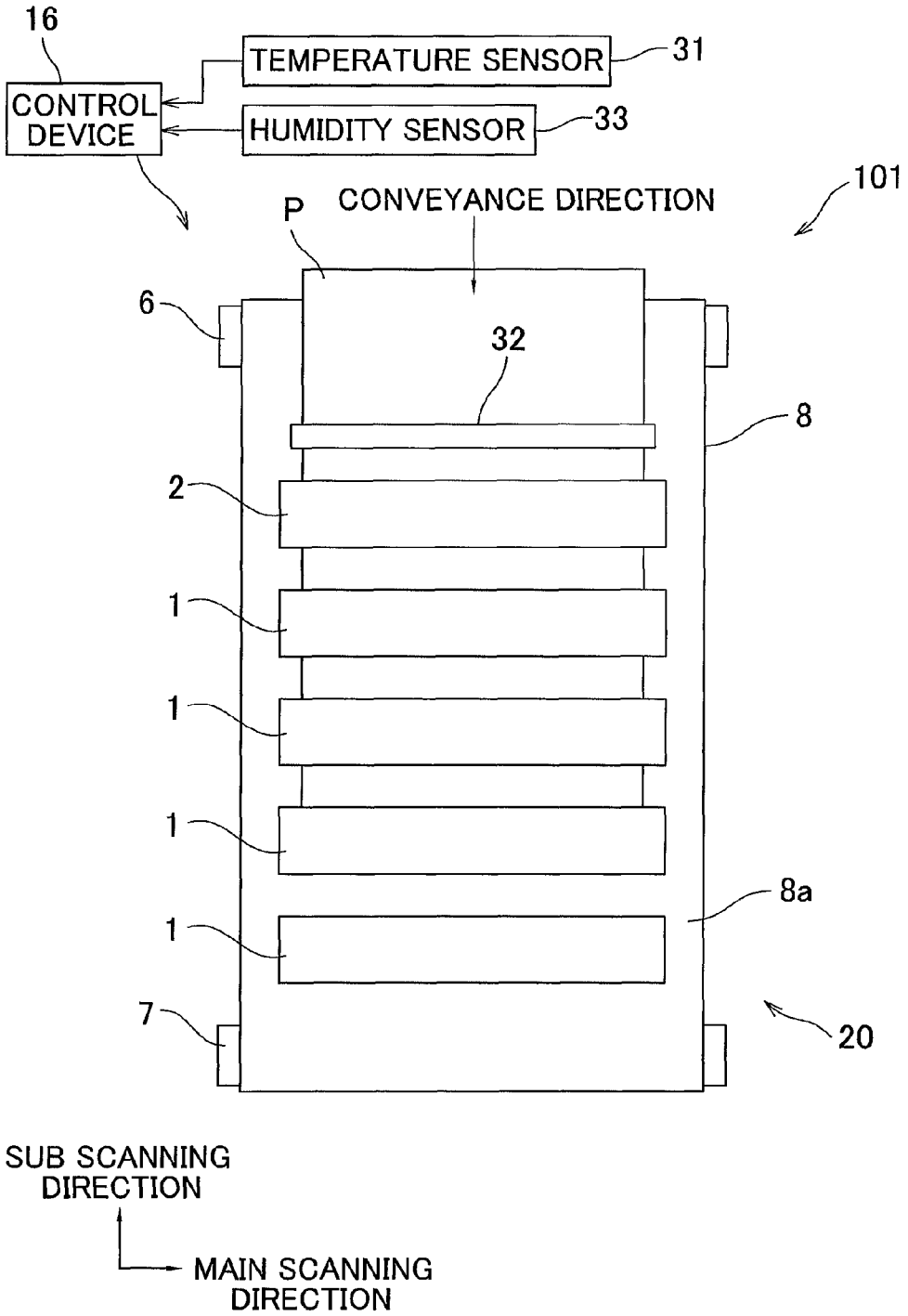
FIG. 1 is a plan view schematically showing an ink-jet printer related to a first embodiment of the present invention.

The ink-jet printer 101 has, along a sheet conveyance path thereof, a sheet supply unit which accommodates and supplies sheets P, a conveyor which conveys each of the sheets P, an image formation unit which forms an image on the sheet P, a sheet output part which accommodates a sheet P having undergone image formation. Of these, the conveyor is structured mainly by a conveyor unit 20, as shown in FIG. 1. The image formation unit includes four ink-jet heads 1 (hereinafter, heads 1), a single precoat head 2 (hereinafter, head 2), and a control device 16. When an image is formed, ink and a transparent precoat liquid are ejected from the heads 1 and 2, to the sheet P conveyed by the conveyor unit 20.

As a component of the precoat liquid, a component which aggregate pigment is used for pigment ink, and a component which precipitates dye is used for dye ink. The precoat liquid uses water as the main solvent, and is prepared by selectively using multivalent metallic salt such as magnesium salt or calcium salt, in addition to cation based macromolecules such as diallyl dimethyl ammonium chloride polymer, diallyl methyl ammonium salt polymer, or the like. When ink is placed on an area of a sheet P on which the precoat liquid is applied in advance, the multivalent metallic salt, or the like acts on the dye or pigment serving as the colorant of the ink, and forms (aggregates or precipitates) an insoluble or hardly-soluble metal composite or the like. As a result, the level of infiltration of the colorant adhered into the sheet P is lowered, and the colorant is more easily settled on the sheet P.

As shown in FIG. 1, the conveyor unit 20 has two belt rollers 6, 7, and an endless conveyor belt 8 looped around the both rollers 6, 7. The belt roller 7 is a drive roller and rotates with the drive force given by a not-shown conveyance motor. When belt roller 7 rotates, the conveyor belt 8 runs. The belt roller 6 is a driven roller, and rotates as the conveyor belt 8 runs. The sheet P placed on the surface 8*a* of the conveyor belt 8 is conveyed from the upper middle to the bottom of FIG. 1. Note that in the present embodiment, a sub scanning direction is a direction parallel to a direction of conveying the sheet P by the conveyor unit 20, and the main scanning direction is a horizontal direction which is orthogonal to the sub scanning direction.

The four heads 1 are line heads with the longitudinal direction in the main scanning direction, and eject ink droplets of Black, Magenta, Cyan, Yellow to the sheet P, respectively. Each of the heads 1 has a head main body 1*a* (see FIG. 2). Each head main body 1*a* has on its under surface an ejection face is having ejection openings 108 (see FIG. 4). The head 2 has a similar structure as those of the heads 1. The head 2 is dispose on the upstream of the four heads 1, relative to the conveyance direction of the sheet P. Further, these heads 1 and 2 are disposed adjacent and parallel to one another, in the sub scanning direction.

Next, the control device 16 is described. The control device 16 controls operation of each part of the printer 101, thus administrating the operation of the entire printer 101. For example, the control device 16 controls an image forming operation, based on image data supplied from an external apparatus (a PC or the like connected to the printer 101). More specifically, the control device 16 controls: conveyance of the sheet P, ejection of the heads 1 and 2 in sync with the conveyance of the sheet P, recovery of ejection characteristics of the heads 1 and 2 (e.g., pre-ejection), or the like. The pre-ejection is detailed later.

To the control device 16 are input results of measurements from a temperature sensor 31 and a humidity sensor 33 installed within the printer 101. These results are used for adjusting the length of a predetermined time period T which is a condition for determination performed by a later-mentioned determiner 155.

The control device 16 controls operations of a not-shown sheet-feeder unit, a conveyor unit 20, and a sheet output unit, based on a record instruction received from an external apparatus. The sheet-feeder unit feeds out the sheet P from the sheet supply unit to the conveyor unit 20. The conveyor unit 20 conveys the sheet P in the sub scanning direction (conveyance direction of the sheet P). When the sheet P passes immediately below the heads 1 and 2, the precoat liquid and the ink are successively ejected from the ejection faces under control by the control device 16, thus forming a color image on the sheet P. At this point, the placement position of each precoat droplet to be placed on the sheet P earlier than ink, is adjusted so as to coincide with the placement position of an ink droplet to be placed afterwards. When an ink droplet is placed on the sheet P, the precoat droplet placed earlier causes aggregation of pigments. As a result, pigments stay nearby the surface of the sheet P, and the quality of image formed on the sheet P is improved. Ejection of the heads 1 and 2 is performed based on a sensor signal from a sheet width sensor 32 which finds out the width of the sheet P. The sheet width sensor 32 is provided upstream of the head 2, relative to the conveyance direction, and detects the anterior end of the sheet P passing below, and finds out the width of the sheet P. The sheet P on which an image is formed is output to the sheet output part by the sheet output unit.

Next, the following details the head main body 1*a* of each of the head 1, with reference to FIG. 2 to FIG. 5. Note that description of the head main body of the head 2 is omitted, for the reason that the structure of the head main body is the same structure as the head main body 1*a*. As the matter of convenience, solid lines is used to draw pressure chambers 110, apertures 112, and ejection openings 108 in FIG. 3 which are below the actuator unit 21 and which should be drawn in broken lines.

Figure 2:
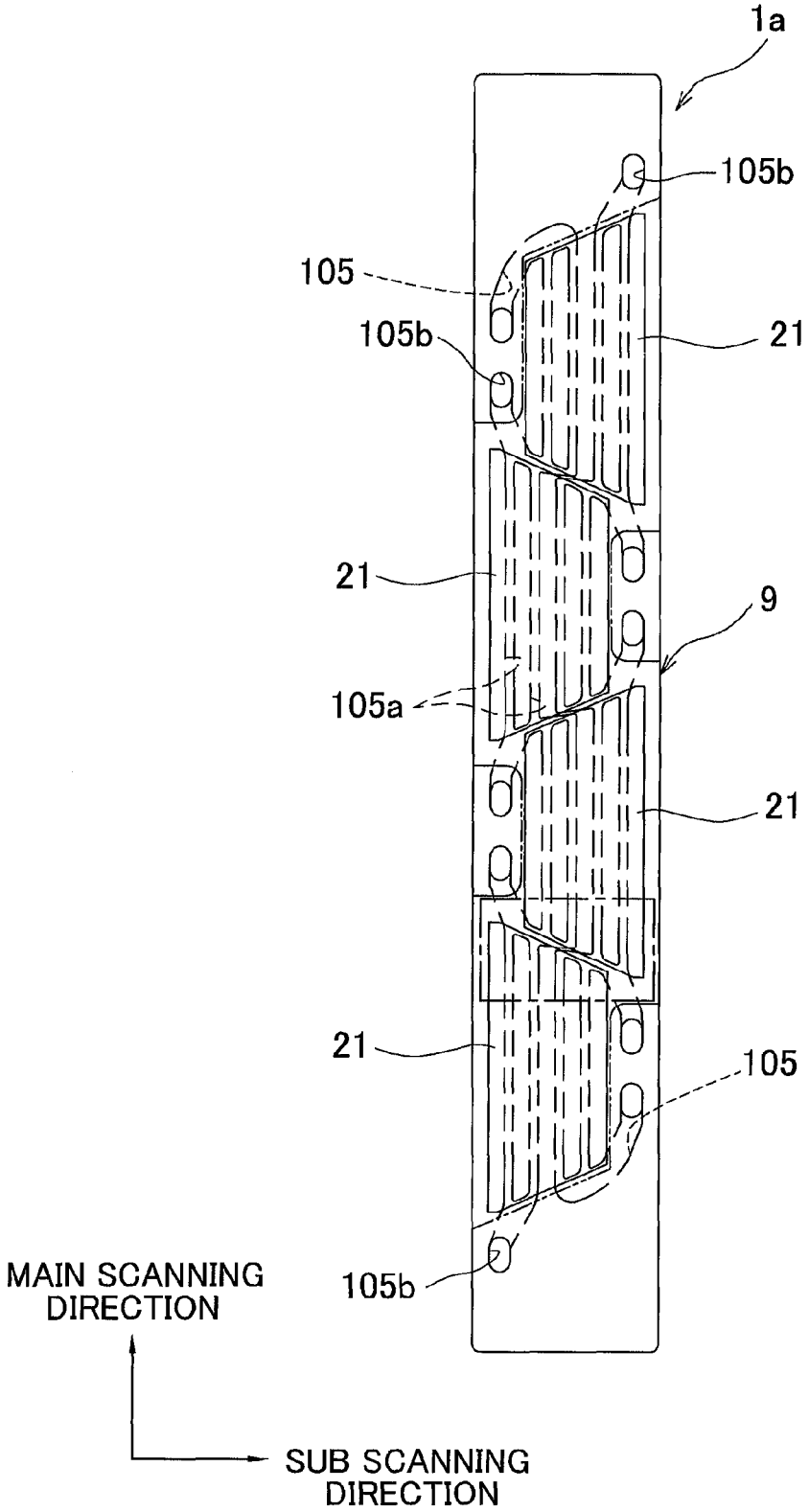
FIG. 2 is a plan view of a head main body contained in the printer of FIG. 1.

As shown in FIG. 2, the head main body 1*a* is a layered body having four actuator units 21 fixed on a top surface of a passage unit 9. The actuator unit 21 includes unimorph actuators corresponding to pressure chambers 110, respectively, and is capable of selectively applying ejection energy to the ink inside the pressure chambers 110. Note that, although illustration is omitted, each of the heads 1 includes: a reservoir unit for storing ink to be supplied to the passage unit 9, a flexible printed circuit (FPC) which supplies a drive signal to the actuator unit 21, and a control substrate which controls a driver IC mounted on the FPC.

Figure 3:
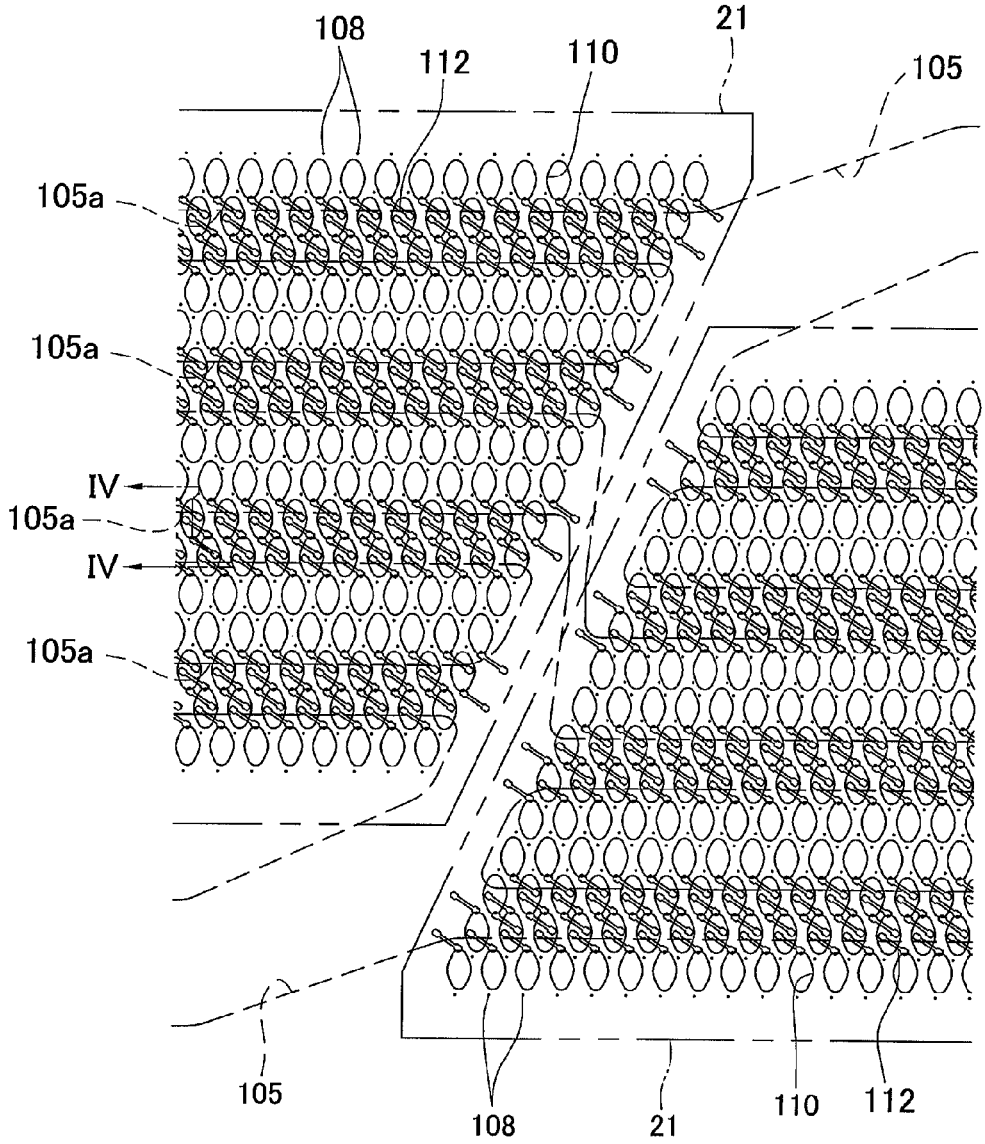
FIG. 3 is an enlarged view of an area surrounded by a dashed line shown in FIG. 2.
Figure 4:
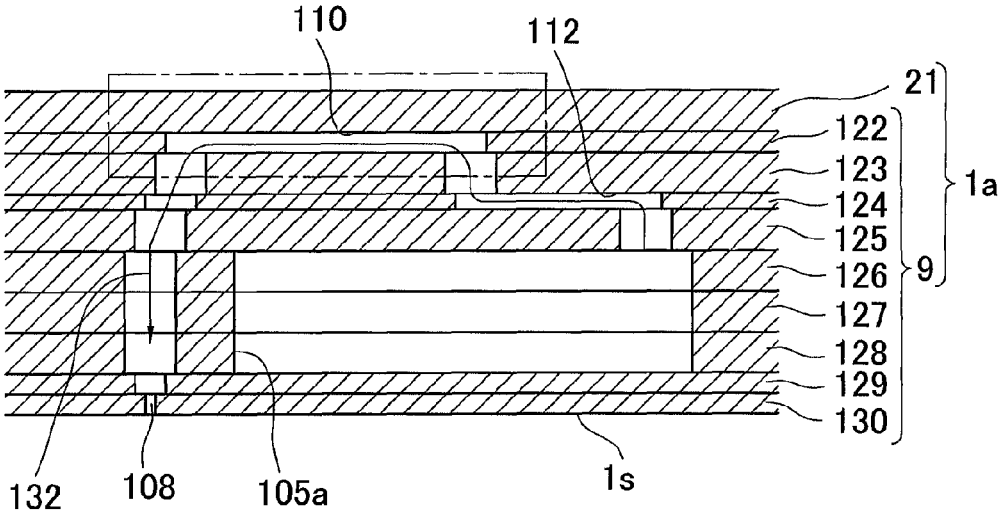
FIG. 4 is a partial cross sectional view taken along the line IV-IV shown in FIG. 3.

As shown in FIG. 4, the passage unit 9 is a layered body formed by stacking nine stainless metal plates 122 to 130. As shown in FIG. 2, on the top surface of the passage unit 9, there are a total of ten ink supply openings 105*b* which are in communication with the reservoir unit. As shown in FIG. 2 to FIG. 4, inside the passage unit 9 are formed manifold channel 105 whose one end is an ink supply opening 105*b*, and sub manifold channels 105*a* branched off from the manifold channel 105. Further, inside the passage unit 9 are formed individual ink passages 132 which extend from the outlets of the sub manifold channels 105*a* to the ejection openings 108 on the ejection face 1*s*, via the pressure chambers 110, respectively. The ejection openings 108 formed on the ejection face 1*s* are arranged in matrix at intervals of 600 dpi, which is a resolution relative to the main scanning direction.

The following describes a flow of ink in the passage unit 9. As shown in FIG. 2 to FIG. 4, ink supplied from the reservoir unit to an ink supply opening 105*b* flows into a manifold channel 105 (a sub manifold channel 105*a*). The ink in the sub manifold channel 105*a* is distributed to the individual ink passages 132, and reaches the ejection opening 108 via an aperture 112 and a pressure chamber 110.

Next, the following describes the actuator unit 21. As shown in FIG. 2, the four actuator units 21 each has a trapezoidal plane shape, and are aligned in the main scanning direction, in a zigzag manner so as to avoid the ink supply openings 105*b*. Parallel sides of each actuator unit 21 are parallel to the main scanning direction, and the tilted sides of the actuator units 21 overlap one another, relative to the sub scanning direction of the passage unit 9.

Figure 5:
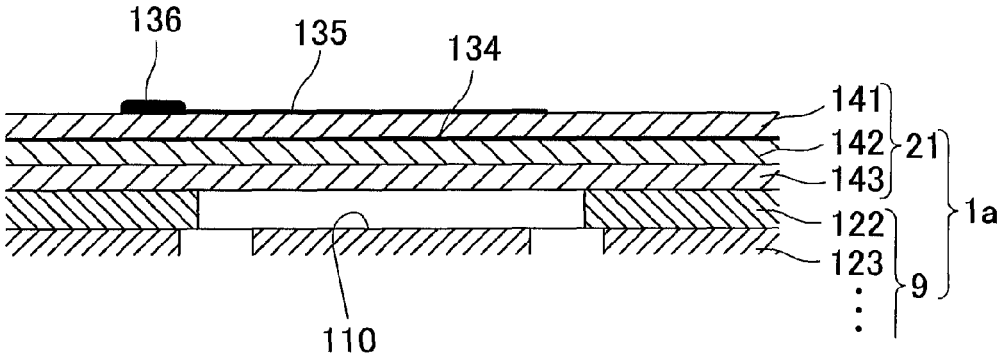
FIG. 5 is an enlarged view of an area surrounded by a dashed line shown in FIG. 4.

As shown in FIG. 5, the actuator unit 21 is a piezoelectric actuator which is structured by three piezoelectric layers 141 to 143 made of a ferroelectric ceramics based on lead zirconate titanate (PZT). The uppermost layer of the piezoelectric layer 141 is polarized in a direction of its thickness. Further, on the top surface of the piezoelectric layer 141 are formed individual electrodes 135. Each individual electrode 135 faces a pressure chamber 110. At the anterior end of the individual electrode 135 is provided an individual land 136. Between the piezoelectric layer 141 and the piezoelectric layer 142 below is interposed a common electrode 134 formed throughout the surfaces of these layers. Note that the ground potential is equally applied to the areas of the common electrode 134 corresponding to the pressure chambers 110. On the other hand, to the individual electrode 135, a drive signal is selectively supplied via the individual lands 136.

When the electric potential of the individual electrode 135 is made different from that of the common electrode 134, the portion between the individual electrode 135 and the pressure chamber 110 deforms relative to the pressure chamber 110. As such, the portion corresponding to the individual electrode 135 serves as an individual actuator. That is, to the actuator unit 21 are built in actuators in number corresponding to the number of the pressure chambers 110.

Here, the following describes a method of driving the actuator unit 21. The actuator unit 21 is so-called unimorph actuator having: the piezoelectric layer 141, which is an upper layer distanced from the pressure chamber 110, serving as a layer including a drive active portion, and the piezoelectric layers 142 and 143, which are two lower layers close to the pressure chamber 110, serving as inactive layers. For example, where the polarize direction and the direction of applying an electric field are the same, drive active portion (the portion sandwiched by the both electrodes 134 and 135) constricts in directions (in-plane directions) orthogonal to the polarize direction. Since distortion in the in-plane directions occurs between the portion to which an electric field is applied (drive active portion) and the piezoelectric layers 142 and 143 below, the entire piezoelectric layers 141 to 143 (individual actuator) deform into a convex projecting towards the pressure chamber 110 (unimorph deformation). This applies a pressure (ejection energy) to the ink inside the pressure chamber 110, thus ejecting an ink droplet from the ejection opening 108.

Note that the drive signal applied in the present embodiment applies in advance a predetermined electric potential to the individual electrode 135; brings the potential of the individual electrode 135 to the ground potential in response to each ejection request, and then applies again the predetermined electric potential to the individual electrode 135 at a predetermined timing. When the individual electrode 135 is brought to the ground potential, the piezoelectric layers 141 to 143 returns to their original states, and the volume of the pressure chamber 110 increases as compared with its initial state (the state during which a voltage is applied in advance). This causes the ink to be sucked into the individual ink passage 132, from the sub manifold channel 105*a*. When the predetermined electric potential is again applied to the individual electrode 135, the portions of the piezoelectric layers 141 to 143 corresponding to the portion where the electric field is applied deforms into a convex projecting towards the pressure chamber 110, thereby decreasing the volume of the pressure chamber 110 (i.e., increases the pressure of the ink). Thus, an ink droplet is ejected from the ejection opening 108.

Figure 6:
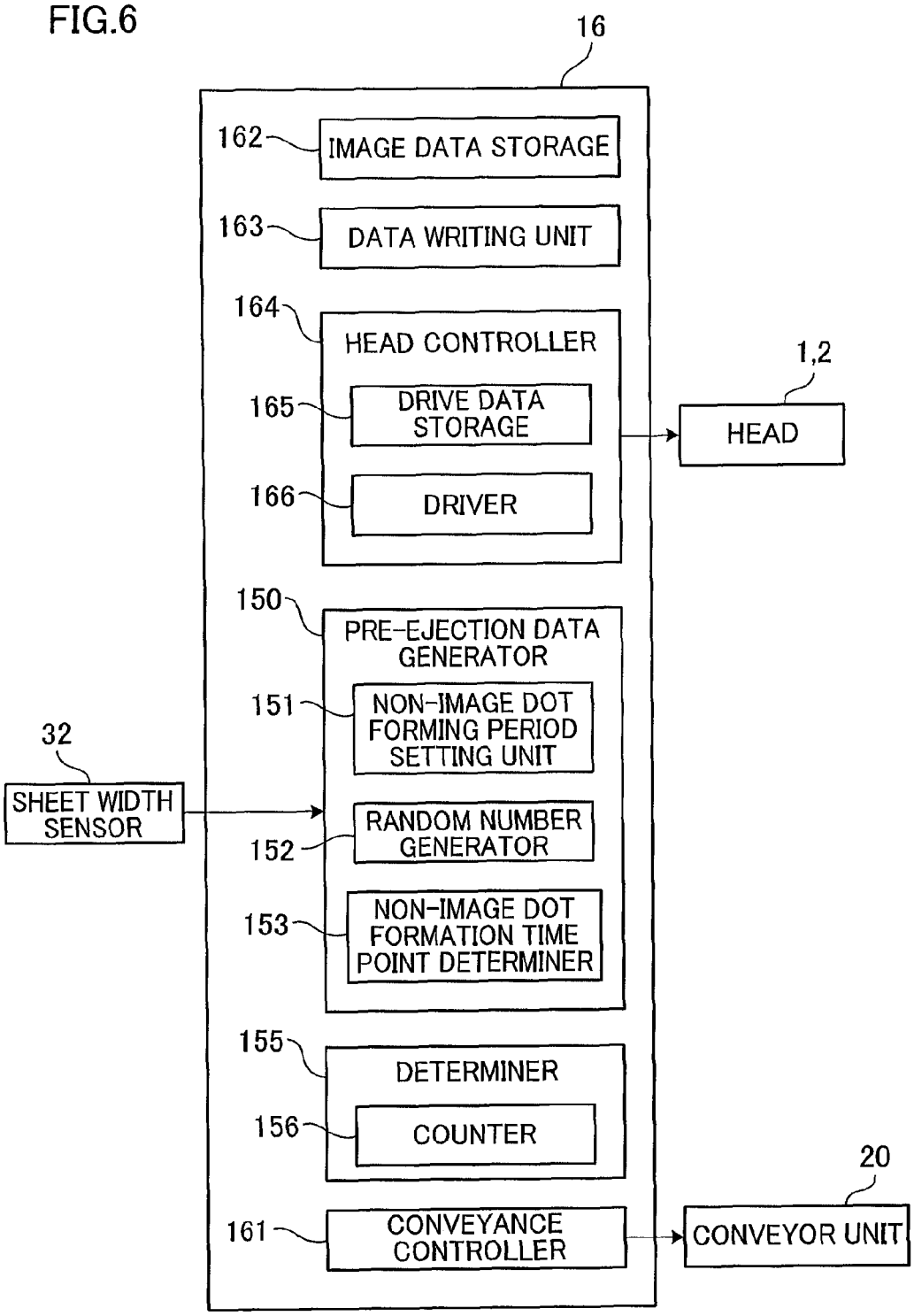
FIG. 6 is a functional block diagram of a control device (controller) shown in FIG. 1.

Next, the following describes the control device 16 with reference to FIG. 6. The control device 16 includes: a CPU (Central Processing Unit); a ROM (Read Only Memory) which rewritably stores a program to be run by the CPU and data to be used in the program; and a RAM (Random Access Memory) which temporarily stores data while the program is run. The functional parts the control device 16 are realized in combination of hardware and software in the ROM. As shown in FIG. 6, the control device 16 has a conveyance controller 161, an image data storage 162, a data writing unit 163, a head controller 164, a pre-ejection data generator 150, and the determiner 155.

The conveyance controller 161 controls the operations of the sheet-feeder unit, the conveyor unit 20, and the sheet output unit so that the sheet P is conveyed at a predetermined in the conveyance direction.

The head controller 164 controls driving of the actuators in each actuator unit 21 of the heads 1. The head controller 164 has: a drive data storage 165 which stores data which is written in, as actuator drive data; and a driver 166 which outputs a drive signal for driving the actuators to the actuator. The driver 166 has a driver IC for generating the drive signal amplified based on the drive data. The head controller 164 outputs a drive signal at a timing synchronized with the conveyance of the sheet P, based on an output from the sheet width sensor 32.

The image data storage 162 stores image data having been transferred from an external apparatus. The image data indicates, for each color and for each ejection opening 108, information such as dot sizes (any of the following four sizes: zero, small, medium, large) and/or the dot formation positions of printing cycles. Note that one printing cycle is a time consumed for the sheet P to move relatively to the heads 1 by a unit distance corresponding to the printing resolution, in the sheet conveyance direction. Further, in the present embodiment, the dot sizes of large, medium, and small are formed by the total ejection amount of ink of 15 pl (pico litter), 10 pl, and 5 pl, respectively.

The data writing unit 163 writes in image data stored in the image data storage 162 to the drive data storage 165 of the head controller 164. This way, the head controller 164 is able to selectively control driving of each actuator based on the image data. In other words, the head controller 164 in combination with the data writing unit 163 structures an image dot controller which forms image dots 81 (see FIG. 7) structuring pixels of an image 80 (see FIG. 7) on the sheet P.

The determiner 155 successively determines, for each ejection opening 108, whether or not an image dot non-forming period is equal to or longer than a predetermined time period T, based on the image data stored in the image data storage 162. The image dot non-forming period is a period during which no image dot 81 is formed successively in the conveyance direction; i.e., a period from a first time point where an image dot 81 is formed to another time point where a subsequent image dot 81 is formed.

The determiner 155 stores the length of the predetermined time period T which is set in association with conditions such as temperature and humidity. The predetermined time period T corresponds to the frequency of performing the pre-ejection, and is set in advance, in consideration of deterioration in the ejection performance of the ejection openings 108 due to thickening of the ink. The predetermined time period T is a period in which the thickness of ink to be ejected from the ejection openings 108 is not affected, during image formation. Thickening of ink causes decrease in the amount of each ink droplet and variation in the placement positions of the ink droplets. The predetermined time period T corresponds to a longest period during which variation in the placement positions of the ink droplets are hardly recognizable. Surpassing this predetermined time period T will lead to unstable ejection characteristic, and the above mentioned problems will be actualized in the form of image quality. A specific method of setting the predetermined time period T is described later. Based on the detection results from the temperature sensor 31 and the humidity sensor 33, the determiner 155 obtains the lengths of the predetermined time period T according to these environmental conditions, and performs the above described determination based on the predetermined time period T. The predetermined time period T may be different between the heads 1 and the head 2. The determiner 155 has a counter 156. The counter 156 counts the number of pixels without formation of image dot 81, so as to determine whether or not the image dot non-forming period is equal to or longer than the predetermined time period T. This counter 156 is detailed later.

Figure 7:
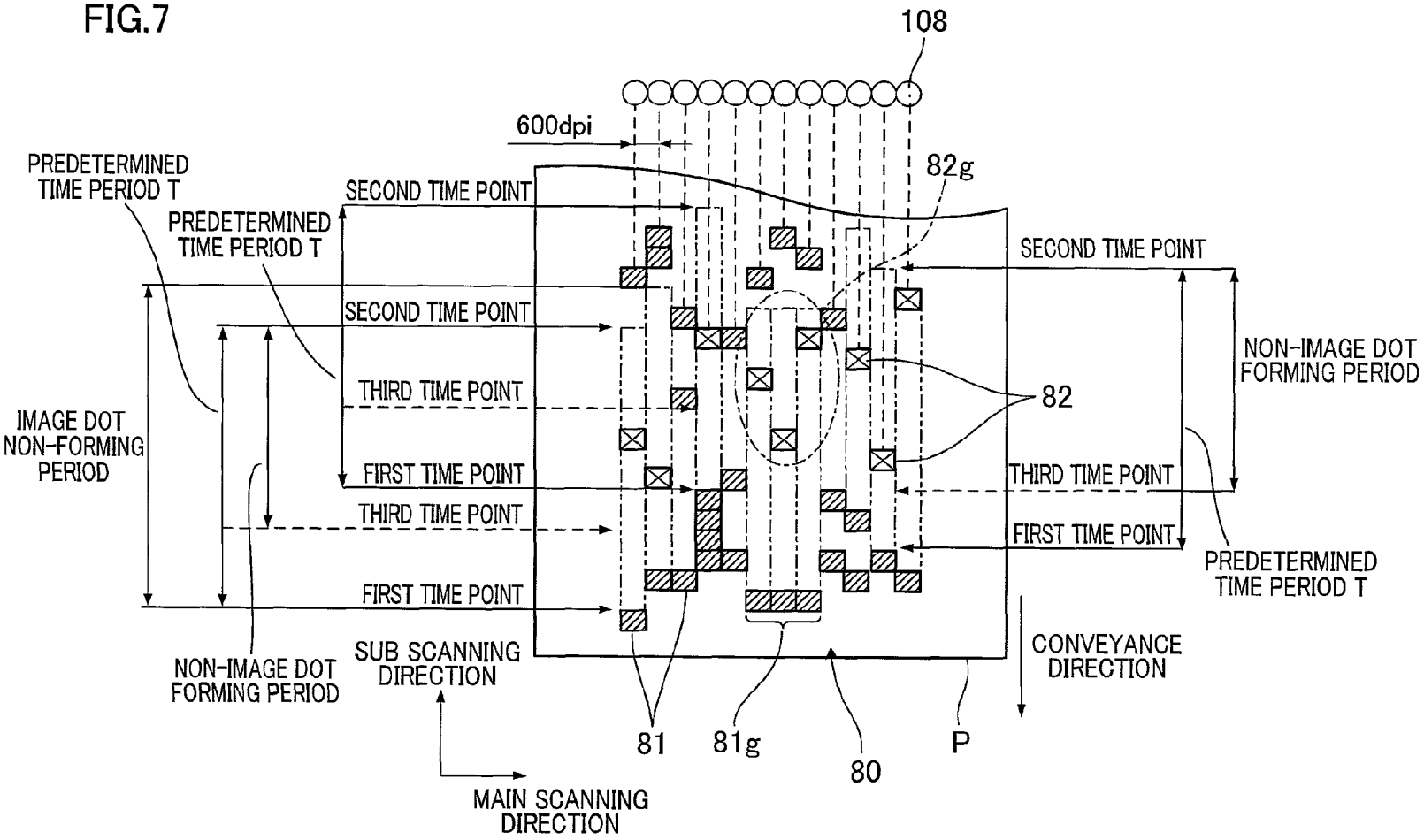
FIG. 7 is a diagram showing an example of image dots and non-image dots, which are formed on a sheet, based on control by the control device of FIG. 6.

For each of the ejection openings 108 whose image dot non-forming period is determined as to be equal to or longer than the predetermined time period T, the pre-ejection data generator 150 generates pre-ejection data to perform one pre-ejection to the sheet P within a period from the first time point which is the start point of the image dot non-forming period to a second time point which is exactly the predetermined time period after the first time point, and then outputs the pre-ejection data to the drive data storage 165 of the head controller 164. Here, the one pre-ejection means pre-ejection performed within one printing cycle. For example, the one pre-ejection encompasses successive ejection of droplets of ink from the ejection opening 108 within one printing cycle. In one pre-ejection, an ink droplet or a precoat droplet of approximately 3 pl is ejected, thus forming one non-image dot 82 on the sheet P. The non-image dot 82 is a dot which is not based on the image data. For each of the ejection openings 108, FIG. 7 shows an exemplary range of pixels from the first time point to the second time point which is indicated by double-dashed line.

The pre-ejection data generator 150 includes: a non-image dot forming period setting unit 151; a random number generator 152; and a non-image dot formation time point determiner 153. These units 151 to 153 in combination with one another generate the pre-ejection data. The non-image dot forming period setting unit 151 sets the non-image dot forming period (see FIG. 8). The non-image dot forming period is a period in which a single non-image dot 82 is formed through one pre-ejection. This period is set within a period from a third time point to the second time point, the third time point being later than the first time point. A method of determining, where in between the first time point and the second time point, the third time point is set is described later.

The random number generator 152 generates random numbers each indicating whether or not a non-image dot 82 is formed at any time point within the non-image dot forming period. The non-image dot formation time point determiner 153 determines the timing for forming the non-image dot 82, based on the random number generated by the random number generator 152. The pre-ejection data generator 150 generates pre-ejection data for performing pre-ejection at the timing determined by the non-image dot formation time point determiner 153, and outputs the data to the drive data storage 165 of the head controller 164.

At this time, the pre-ejection data generator 150 adjusts the pre-ejection data once determined by the random number, for the following two purposes. One is to keep the non-image dot 82 of the precoat liquid and that of the ink from overlapping each other, thereby preventing the non-image dots 82 from being noticeable. To this end, the pre-ejection data generator 150 compares the pre-ejection timing and the position of the ejection opening 108 of the head 1 with those of the head 2. If the position of the non-image dot 82 to be formed by the head 1 overlaps the position of the non-image dot 82 to be formed by the head 2, the pre-ejection data is adjusted so that these positions do not overlap each other. For example, the pre-ejection timing of the head 1 or the head 2 is shifted, or pre-ejection of one of the heads 1 and 2 is cancelled.

The second is to prevent the pre-ejection to an area beyond the width of the sheet P, thereby preventing the conveyor belt 8 and inside the printer 101 from being contaminated. To this end, the pre-ejection data generator 150 adjusts the pre-ejection data based on the result given from the sheet width sensor 32 so as to cancel pre-ejection of an ejection opening 108 corresponding to a position beyond the width of the sheet P. To recover the ejection performance of the ejection opening 108 whose pre-ejection has been cancelled, the meniscus may be subjected to minute vibration to the extent that no liquid ejection occurs.

Thus, the head controller 144 is able to control driving of the actuators based on the pre-ejection data. In other words, the head controller 164 and the pre-ejection data generator 150 in combination with each other structure the non-image dot controller, and form on the sheet P non-image dots 82 which are different from image dots 81. Further, for each of the ejection openings 108, one pre-ejection is performed within the image dot non-forming period to form a non-image dot 82, when the image dot non-forming period is equal to or longer than the predetermined time period T. Since the position for forming each non-image dot 82 is based on a random number, non-image dots 82 formed by the ejection openings 108 are scattered in the conveyance direction, as shown in FIG. 7.

For example, suppose the non-image dot 82 is formed at a constant distance from an image dot 81. If this is the case in FIG. 7, the non-image dots 82 formed in relation to a group of image dots 81*g* in which three image dots 81 are aligned straight in the main scanning direction, are also aligned straight in the main scanning direction. This increases the possibility that the non-image dots 82 become visually noticeable. On the other hand, in the present embodiment, the non-image dots 82 formed in relation to the group of image dots 81*g* are scattered as a group of non-image dots 82*g*. Therefore, the non-image dots 82 are not noticeable.

Figure 9:
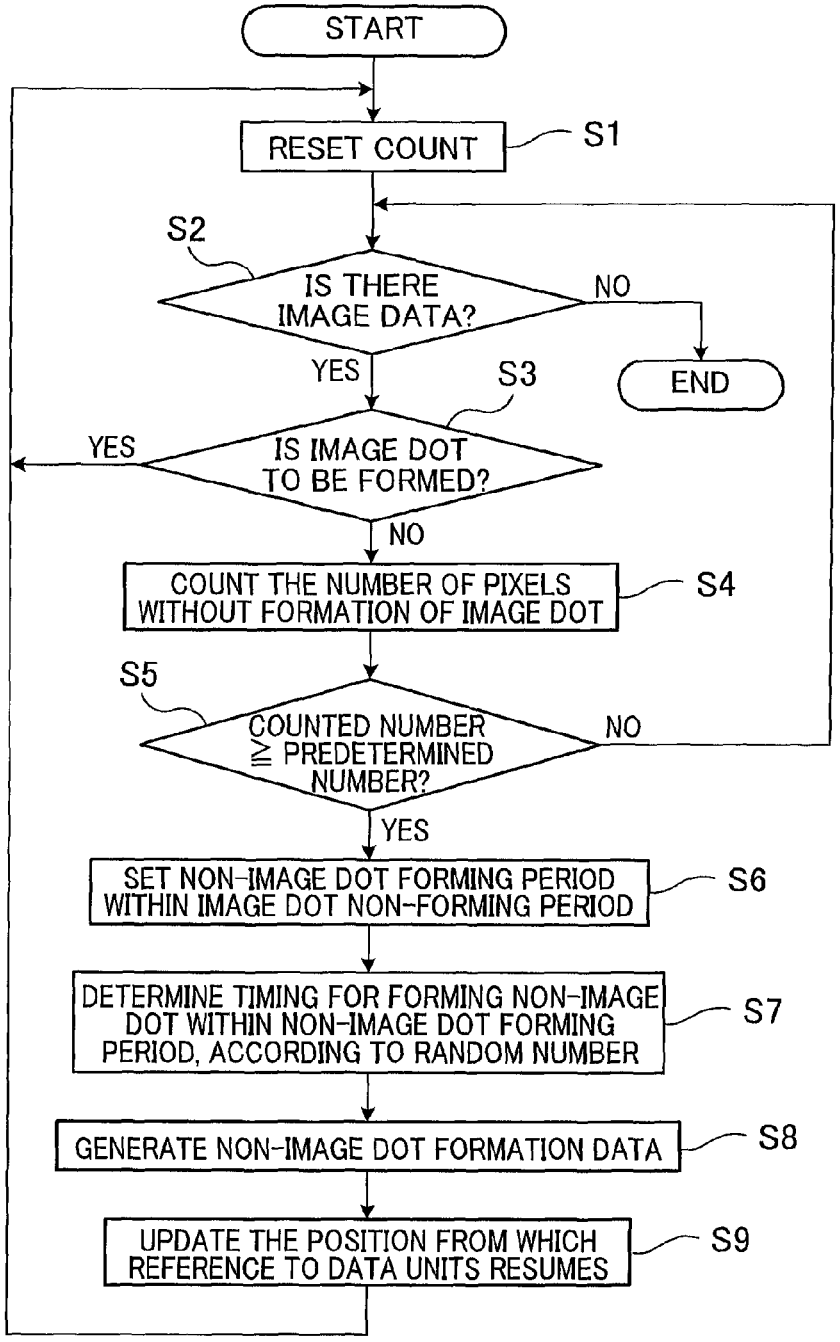
FIG. 9 is a flowchart showing a flow of processes by the control device of FIG. 6.

The following describes, with reference to FIG. 9, a specific flow of the processes executed by the determiner 155 and the pre-ejection data generator 150. First, the counter 156 resets the count for determination (S1). Next, the determiner 155 determines whether or not the image data storage 162 stores image data, based on which image dots 81 are formed (S2). When no image data is determined as to be left (S2: NO), the series of processes are ended.

When the determiner 155 determines that there still remains image data (S2: YES), data units in the image data are successively referred to in the conveyance direction to determine for each ejection opening 108 whether each of the data units indicates formation of an image dot 81 (S3). When not indicated (S3: NO), the counter 156 counts the number of pixels with no image dots 81, while successively referring to the data units in the image data (S4). Then, the determiner 155 determines whether or not the counted number has reached a predetermined number n (where n is natural number of 2 or higher) which corresponds to the predetermined time period T (S5: see FIG. 8). Note that the counted number reaching the predetermined number n is equivalent to the image dot non-forming period reaching the predetermined time period T. When it is determined that the predetermined number n has not been reached (S5: NO), the process returns to S2. Note that when the printer 101 has modes which are different from one another in the sheet conveyance speed, the predetermined number n corresponding to the predetermined time period T varies. In this case, the determiner 155 calculates a suitable predetermined number n based on the current mode.

When the determiner 155 determines that the counted number has reached the predetermined number (S5: YES), the non-image dot forming period setting unit 151 sets a non-image dot forming period within the image dot non-forming period (S6). Specifically, the third time point is set at the time point corresponding to a data unit where n−m+1; i.e., a data unit which is m−1 (where m is a natural number smaller than n) before the data unit corresponding to n (see FIG. 8). Then, the period from the third time point to the second time point is set as the non-image dot forming period.

Next, the non-image dot formation time point determiner 153 determines the timing for forming the non-image dot according to a random number generated by the random number generator 152 (S7). Next, the pre-ejection data generator 150 generates pre-ejection data instructing formation of the non-image dot 82 at the timing thus determined (S8), and outputs the data to the drive data storage 165. Then, the determiner 155 updates the position from which reference to the data units in the image data resumes to a position immediately after the non-image dot formation position (S9). Thus, for example, when no image dot 81 is formed from the time point of executing the pre-ejection, the counting is resumed therefrom. After S9, the process returns to S1.

Figure 8:
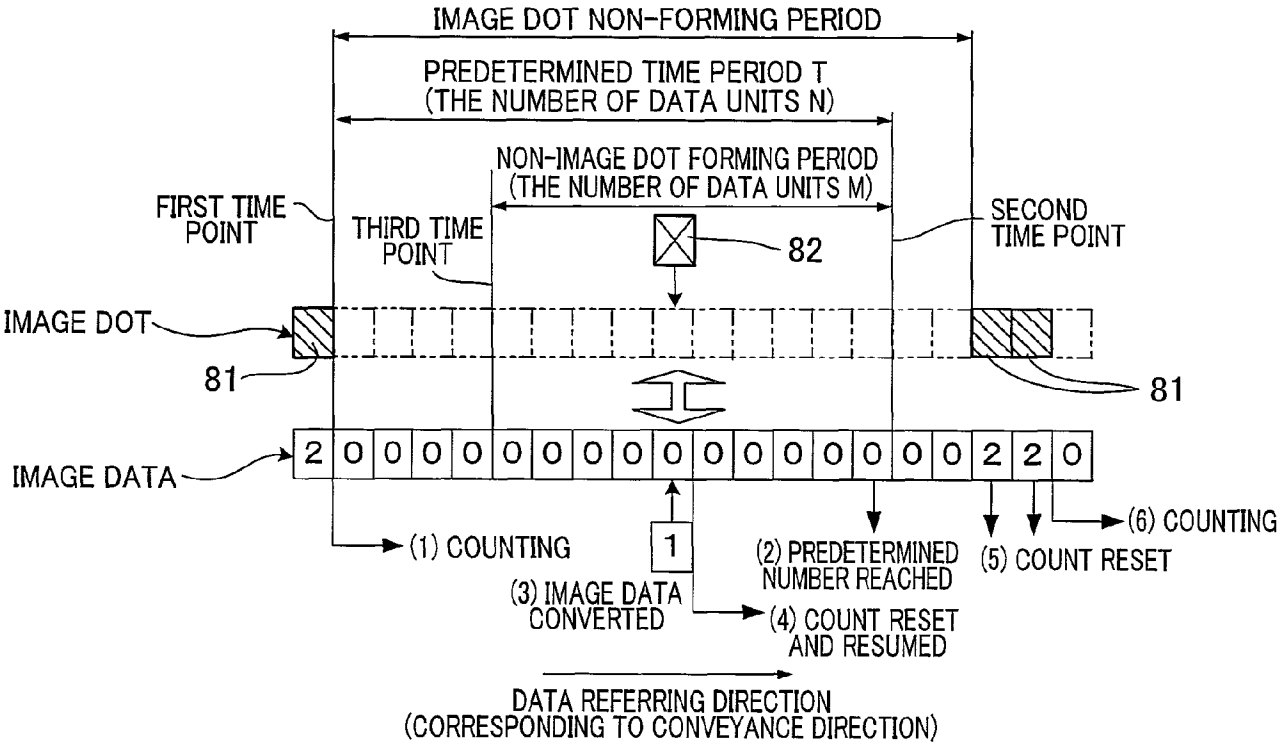
FIG. 8 is a diagram showing a relationship between an image dot formed on a sheet and a corresponding data unit of image data in relation to a single ejection opening, and is also a diagram showing insertion of a non-image dot accompanying conversion of a data unit of the image data through a process of the control device shown in FIG. 6.

The following describes application of the flow of the above process, in relation to the image data of FIG. 8. In the example of FIG. 8, the leftmost data unit and the 18th data unit from the left take the value of "2" which indicates formation of an image dot 81 (hereinafter the expression "from the left" is omitted and simply referred to as "18th data unit" or the like). All of the other data units all take the value of "0" which indicates non-formation of the image dot 81. The determiner 155 starts reference to the data units from the leftmost data unit. Since the leftmost data unit indicates formation of an image dot 81, the counter 156 resets counting (S3: YES-->S1). Data units after the leftmost data unit take the value of "0" indicating non-formation of the image dot 81, and the counter 156 starts incrementing the count from this point (S2: YES->S3: NO->S4->S5: NO->S2). When the 15th data unit taking the value of "0" is counted, the count reaches the predetermined number n (where n=14 in the example shown in FIG. 8) (S5: YES). It should be noted that the second data unit corresponds to the first time point, and the 15th data unit corresponds to the second time point, in this case.

Then, the non-image dot forming period setting unit 151 sets the third time point to the 6th data unit which is m−1 (where m=10 in the example of FIG. 8) before the 15th data unit. In short, a period corresponding to the 6th to 15th data units is set as the non-image dot forming period (S6). Of these 6th to 15th data units, the non-image dot formation time point determiner 153 sets the timing for forming the non-image dot 82 to the timing corresponding to the 10th data unit, based on a random number (S7). Then, the pre-ejection data generator 150 generates the pre-ejection data (S8) and outputs the same to the drive data storage 165. Thus, the 10th data unit of the image data stored in the drive data storage 165 is changed from "0" indicating non-formation of the image dot 81 to "1" indicating formation of the non-image dot 82. Thus, the pre-ejection for forming the non-image dot 82 is executed at the timing corresponding to the data unit. As is understood from this, the pre-ejection data generator 150 structures the data converter, and converts the image data so that a non-image dot 82 is formed.

Next, the counter 156 resets the count, and resumes counting from the 11th data unit which is immediately after the 10th data unit (S9, S1 to S5). Then, when reference to the data units reaches the 18th and 19th data units which are data units before the count reaches n, the count is reset (S3: YES->S1). Then, the counter 156 starts counting from the 20th data unit.

Figure 10:
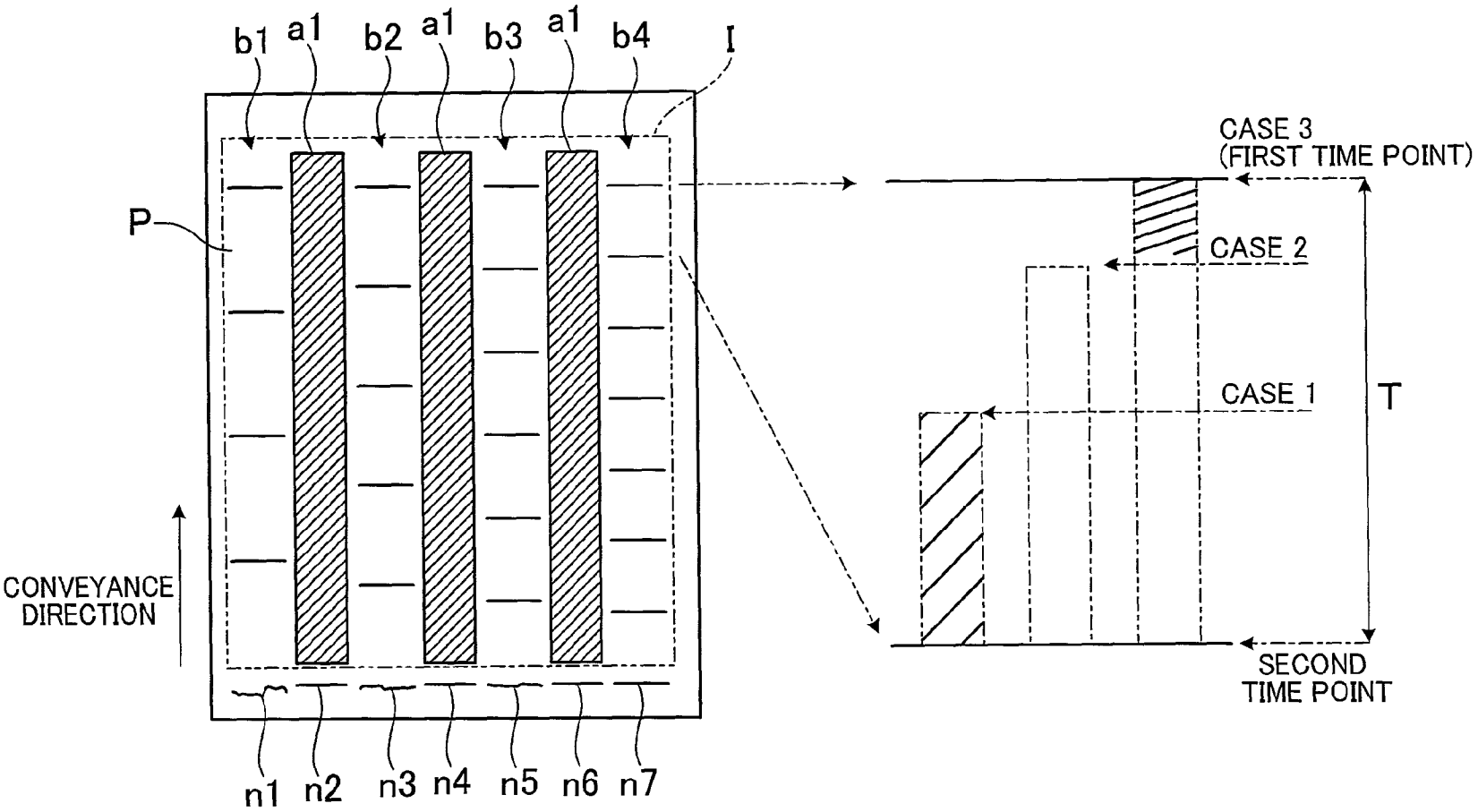
FIG. 10 is a diagram showing a test image or the like used when obtaining various settings for the control device of FIG. 6.

The following describes, with reference to FIG. 10, a method of setting the predetermined time period T which is a condition for determination by the determiner 155. The predetermined time period T is set by evaluating the test image which is formed through pre-ejection of ink or a precoat liquid to the sheet P under predetermined environmental conditions. The test image I which is an exemplary test image has solid images a1 extending substantially throughout the sub scanning direction of the sheet P, as shown in FIG. 10. Further, between the solid images a1 are line columns b1 to b4 each including lines extending in the main scanning direction and aligned in the sub scanning direction at the same intervals. Each of the line columns b1 to b4 includes 4 to 7 lines.

After the solid images a1 and the line columns b1 to b4 are formed, lines n1 to n7 are formed by image dots 81 in the same positions relative to the conveyance direction, at the upstream of these lines relative to the conveyance direction. As shown in FIG. 10, the lines n2, n4, n6 at the upstream of the solid images a1 relative to the conveyance direction are properly formed. However, the lines n1, n3, n5 at the upstream of the line columns b1 to b3 relative to the conveyance direction include image dots 81 whose placement positions are made irregular towards the upstream relative to the conveyance direction. This is due to deterioration of the ejection performance caused by thickening of the ink or the like, in the ejection openings 108 corresponding to the line column b1 to b3, which eject less compared to the ejection openings 108 corresponding to the solid images a1.

On the other hand, the line n7 which is at the upstream of the line column b4 relative to the conveyance direction is properly formed. This shows that, for the length of the sheet P, seven pre-ejections will restrain deterioration of the ejection performance caused by thickened ink. Based on this, a time taken for conveying one seventh of the length of the sheet P is set as the predetermined time period T which is suitable for the environmental conditions under which the test was conducted. For example, where the number of dots corresponding to the sheet P is 7000 dots, a time taken for conveying the length of the sheet corresponding to 1000 dots will be set as the predetermined time period T.

The required frequency of performing the pre-ejection differs depending on the environmental conditions such as the temperature and the humidity and differences among the heads. However, an appropriate predetermined time period T is settable by conducting and modifying the above test while. Since the predetermined time period T corresponds to the frequency of performing the pre-ejection, a suitable frequency according to the conditions is set. In general, high temperatures cause low viscosities of the ink or the like, and require less frequent pre-ejection. Therefore, the predetermined time period T in is set to be long. Similarly, the higher the humidity, the less likely that the ink or the like will be dried. Therefore, the predetermined time period T is set to be long. Further, different predetermined time periods T may be set for the heads 1 and head 2, respectively, according to the type of liquid to be ejected, such as ink or a precoat liquid.

Next, the following describes, with reference to FIG. 10, a method of setting where in between the first time point and the second time point, the third time point will be set. This method is mainly used for deciding the determination conditions related to the heads 1. The determination conditions related to the head 2 may be the same as those related to the head 1, or may include a shorter or longer predetermined time period T than that for the heads 1. Non-image dots 82 formed by a transparent precoat liquid is hardly visible in the first place. Therefore, the non-image dots 82 are less likely noticeable even if the frequency of performing the pre-ejection is high. From this view point, the predetermined time period T for the head 2 may be shorter than the predetermined time period T for the heads 1.

As mentioned above, the line column b4 corresponds to a suitable predetermined time period T. Therefore, a third time point was set at various points within a range of two lines in the line column b4, and non-image dots 82 were formed between the third time point and the second time point. Then, the results were studied. For example, in case 1, the third time point was set right at the midpoint of the first time point and the second time point. In case 2, the third time point was set 20% of the predetermined time period T (period from the first time point to the second time point) after the first time point. In case 3, the third time point was set at the time point which is the same as the first time point. For each of the cases 1 to 3, a single non-image dot 82 was ejected from each of the ejection openings 108 between the third time point and the second time point, so that the non-image dots 82 were scattered relative to the conveyance direction. Then, the results were studied.

In one example, the non-image dots 82 were more noticeable in case 1 as compared with case 2. This is because the density of the non-image dots 82 is higher in case 1, due to a narrow range in which the non-image dots 82 are scattered. In case 3, the non-image dots 82 formed immediately after the first time point blurred the boundary of the image formed by the image dots 81 at the first time point. This is because, in case 3, the pre-ejection is performed immediately after the first time point; i.e., immediately after ejection of ink forming the line column b4. In other words, inside the ejection openings 108 are not so dried immediately after the ink ejection, and the ink is still easily ejectable. Therefore, the sharpness of the image formed based on the image data is easily lost. Based on the above findings, the third time point of the present embodiment is set at a time point which is at least after the first time point. To add this, the third time point is preferably set at 20% of the predetermined time period T after the first time point, as in case 2.

Whether or not the non-image dots 82 are noticeable may be determined based on a color difference. For example, a colorimeter is used to measure a color difference ΔE between a blank part of a sheet and a part of the sheet with scattered non-image dots 82. Then, the reference for determining that the non-image dots 82 are not noticeable is set at or lower than ΔE=1.4, which is a color difference recognizable by a human.

In the first embodiment described above, a third time point is set after the first time point where the image dot 81 is formed, and the non-image dot 82 is formed within a period from the third time point to the second time point which is the predetermined time period T after the first time point. That is, the non-image dot 82 is formed a certain period after formation of the image dot 81, instead of forming the non-image dot 82 immediately after formation of the image dot 81. If the non-image dot 82 is formed immediately after formation of the image dot 81, the non-image dot 82 is formed very close to the image dot 81. This blurs the edges of the image, causing a loss in the sharpness of the image. With the present embodiment however, the non-image dot 82 is formed in a position which is certain distance away from the image dot 81. The sharpness of the image therefore is hardly lost. Thus, the present embodiment allows formation of the non-image dot 82 while restraining deterioration in the quality of the image 80.

Further, the length of the predetermined time period T corresponding to the frequency of performing the pre-ejection is set suitably for recovering the ejection performance, according to various conditions such as the temperature and the humidity. Therefore, the pre-ejection is performed at the frequency suitable for given conditions.

Next, the following describes, with references to FIG. 11 to FIG. 14, an ink-jet printer of the second embodiment, according to the present invention.

An ink-jet printer of the present embodiment has the same structure as that of the printer 101 of the first embodiment, except in that the ink-jet printer of the present embodiment includes no precoat head 2, and except in the structure and control by the functional parts of the control device 16.

Figure 11:
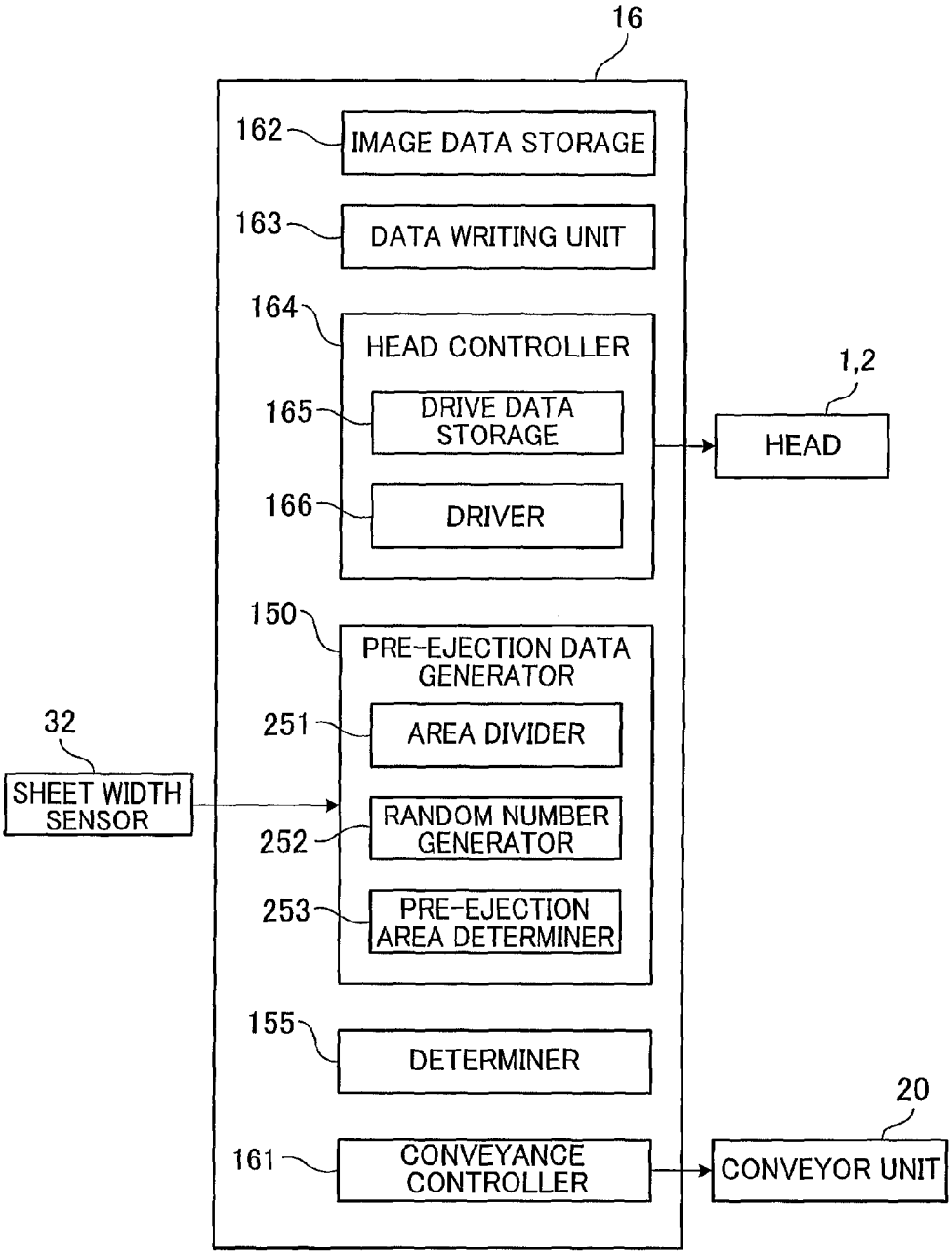
FIG. 11 is a functional block diagram of a control device in the ink-jet printer related to a second embodiment of the present invention.

As shown in FIG. 11, the control device 16 of the present embodiment includes: a conveyance controller 161, an image data storage 162, a data writing unit 163, a head controller 164, a pre-ejection data generator 150, and a determiner 155. Of these functional parts, those different from the first embodiment are the pre-ejection data generator 150 and the determiner 155.

In present embodiment, the determiner 155 does not include the counter 156. The determiner 155 calculates a non-ejection period based on image data stored in the image data storage 162, and successively determine, for each of the ejection openings 108, whether the non-ejection period is equal to or longer than the predetermined time period T. The non-ejection period is a period from a first time point where an ink droplet is ejected from the ejection opening 108 to another time point where subsequent ejection of an ink droplet from the ejection opening 108 occurs. It should be noted that the first time point in the present embodiment is different from the first time point of the first embodiment.

In the present embodiment, the pre-ejection data generator 150 includes: an area divider 251, a random number generator 252, and a pre-ejection area determiner 253. Each of the parts 251 to 253 in cooperation with each other generates pre-ejection data. The pre-ejection data is generated for each ejection opening 108 whose non-ejection period is determined as to be equal to or longer than the predetermined time period T. The pre-ejection data instructs one pre-ejection from the corresponding ejection opening 108, within a time period ranging from the first time point to a second time point which is the predetermined time period T after the first time point. In the present embodiment, the first time point is a time point defining the leading end of the non-ejection period, and is the time point of performing the final ink ejection in the preceding ink ejecting operation.

The non-image dots 82 are formed in a part of a blank area 90 (see FIG. 12) on the sheet P having no image dot 81, which part is prescribed by the predetermined time period T relative to the conveyance direction. The area in which non-image dots 82 can be distributed is referred to as a distribution area 91. The downstream end of the distribution area 91 relative to the conveyance direction is defined by the first time point, and the upstream end relative to the conveyance direction is defined by the second time point.

Figure 12:
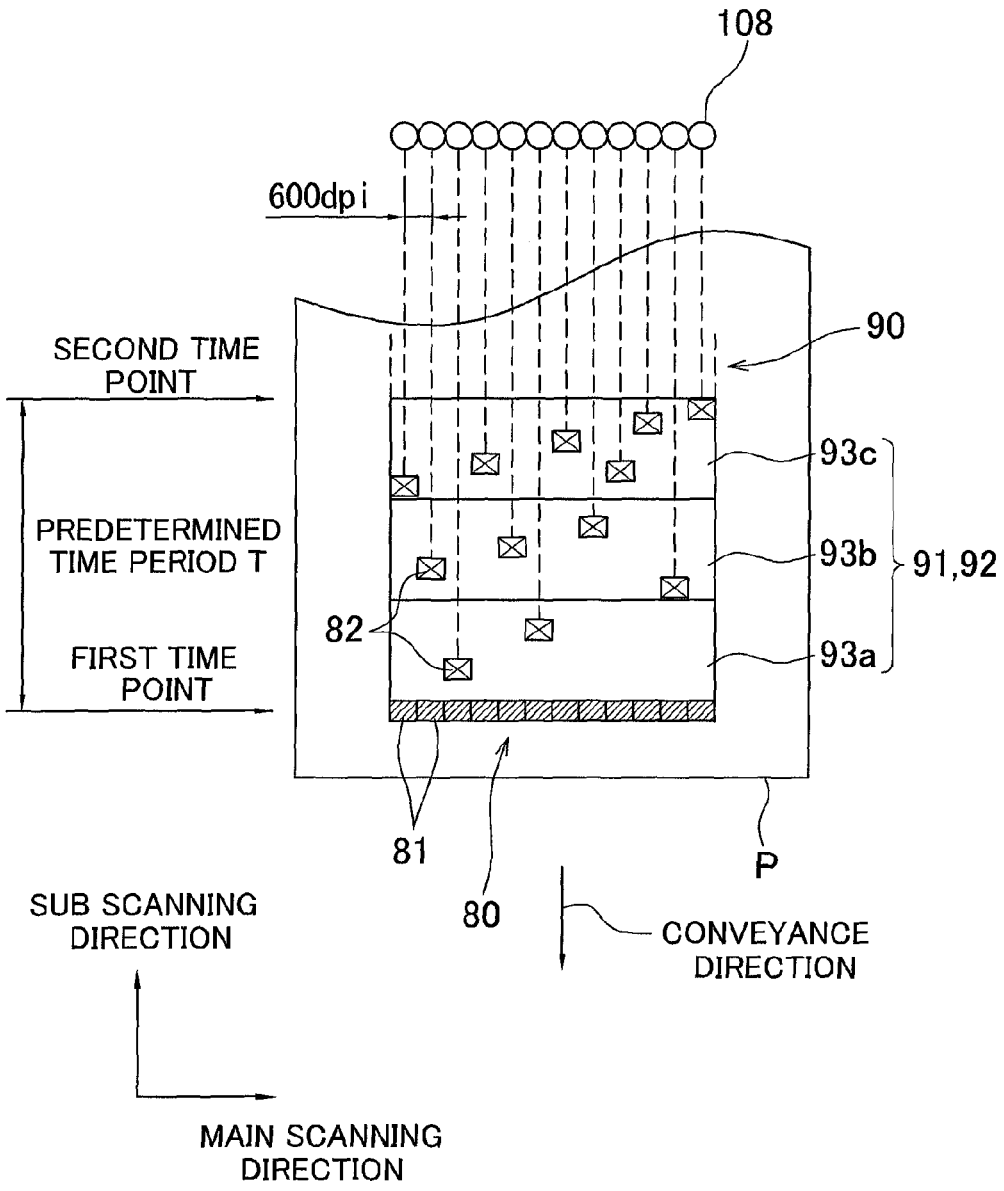
FIG. 12 is an explanatory diagram of a pre-ejection data created by a pre-ejection data generator in the control device of FIG. 11.

The area divider 251 divides an anterior area 92 for an ejection opening 108 whose non-ejection period is determined as to be equal to or longer than the predetermined time period T by the determiner 155 (see FIG. 12). The anterior area 92 is an area which is downstream end of the distribution area 91, relative to the conveyance direction. That is, the anterior area 92 is an area of the distribution area 91, which includes the anterior end of the blank area 90. The anterior end of the blank area 90 is a part following the posterior end of the image 80. The distribution area 91 ranges from the anterior end of the blank area 90 to a position which is a predetermined length away from the anterior end. The predetermined length is a distance corresponding to the predetermined time period T. The posterior end of the image 80 is structured by image dots 81 formed by liquid ejected at the first time point.

FIG. 12 shows a distribution area 91 related to twelve ejection openings 108. In the figure, image dots 81 are formed all at once at the first time point, thus forming a straight line extending in the main scanning direction. The distribution area 91 corresponding to these ejection openings 108 forms a belt-shaped area which extends in the conveyance direction from the image dots 81 forming the posterior end of the image 80. In the present embodiment, the distribution area 91 is the anterior area 92. Further, in the present embodiment, the anterior area 92 is an area corresponding to a beginning section. The beginning section means a section leading to the first time point within a non-ejection period which is equal to or longer than the predetermined time period T. In the present embodiment, the beginning section equals to the predetermined time period T. The area divider 251 divides the anterior area 92 into three areas in the conveyance direction: i.e., divisional areas 93*a* to 93*c*. The respective distances (lengths) of the divisional areas 93*a* to 93*c* in the conveyance direction are equal to one another. Note that the anterior area 92 may be divided into two areas, or four or more areas.

The random number generator 252 generates random numbers corresponding to the divisional areas 93*a* to 93*c*. Information of the random numbers generated is output to the pre-ejection area determiner 253, and used for setting the placement positions of the non-image dots 82.

The pre-ejection area determiner 253 designates a formation area of non-image dots 82 and sets the placement positions within that area, and determines the pre-ejection timing for each of the ejection openings 108. When selecting the formation area, one of the three divisional areas 93*a* to 93*c* is designated for each of the ejection openings 108 whose non-ejection period is determined as to be equal to or longer than the predetermined time period T. At this point, the divisional areas 93*a* to 93*c* to which the ejection openings 108 are assigned are designated by the pre-ejection area determiner 253 so that the number of non-image dots 82 in the anterior area 92 is reduced towards the posterior end of the image 80 (see FIG. 12); i.e., the shorter the period elapsed after the first time point, the smaller the number of non-image dots 82. Specifically, as shown in FIG. 12, the pre-ejection area determiner 253 designates the divisional area 93*a* for two ejection openings 108, the divisional area 93*b* for four ejection openings 108, and the divisional area 93*c* for the remaining six ejection openings 108. At this point, the respective distribution probabilities of the non-image dots 82 in the areas 93*a* to 93*c* are as follows: 1/6 for the divisional area 93*a*, 2/6 in the divisional area 93*b*, and 3/6 in the divisional area 93*c*. As described, the pre-ejection area determiner 253 designates formation areas of the non-image dots 82, based on the probabilities which are set in advance for the three divisional areas 93*a* to 93*c*, respectively.

As mentioned above, closer the distance to the image 80, the smaller the probability of forming the non-image dots 82 is. Therefore, the number of non-image dots 82 formed is the smallest in the divisional area 93*a* among the divisional areas 93*a* to 93*c*. Since the dot diameter of the non-image dot 82 is constant in the present embodiment, the amount of ink to be placed on the divisional area 93*a* is the smallest among the divisional areas 93*a* to 93*c*. Further, when determining the placement positions, the pre-ejection area determiner 253 sets the placement positions of the non-image dots 82 in the divisional areas 93*a* to 93*c*, based on the random numbers given by the random number generator 252. Therefore, the non-image dots 82 are randomly scattered. The above described designation of the formation area and setting of the placement positions determine the timings for forming the non-image dots 82 starting from the first time point. Thus, as shown in FIG. 12, the non-image dots 82 are suitably scattered within the divisional areas 93*a* to 93*c*, and the non-image dots 82 are hardly noticeable.

The above description deals with a case of determining the formation timings of the non-image dots 82, when image dots 81 are formed side by side in the sub scanning direction at the first time point. It however goes without saying that the method is also applicable to cases where image dots 81 are arranged in any given positions.

Figure 13:
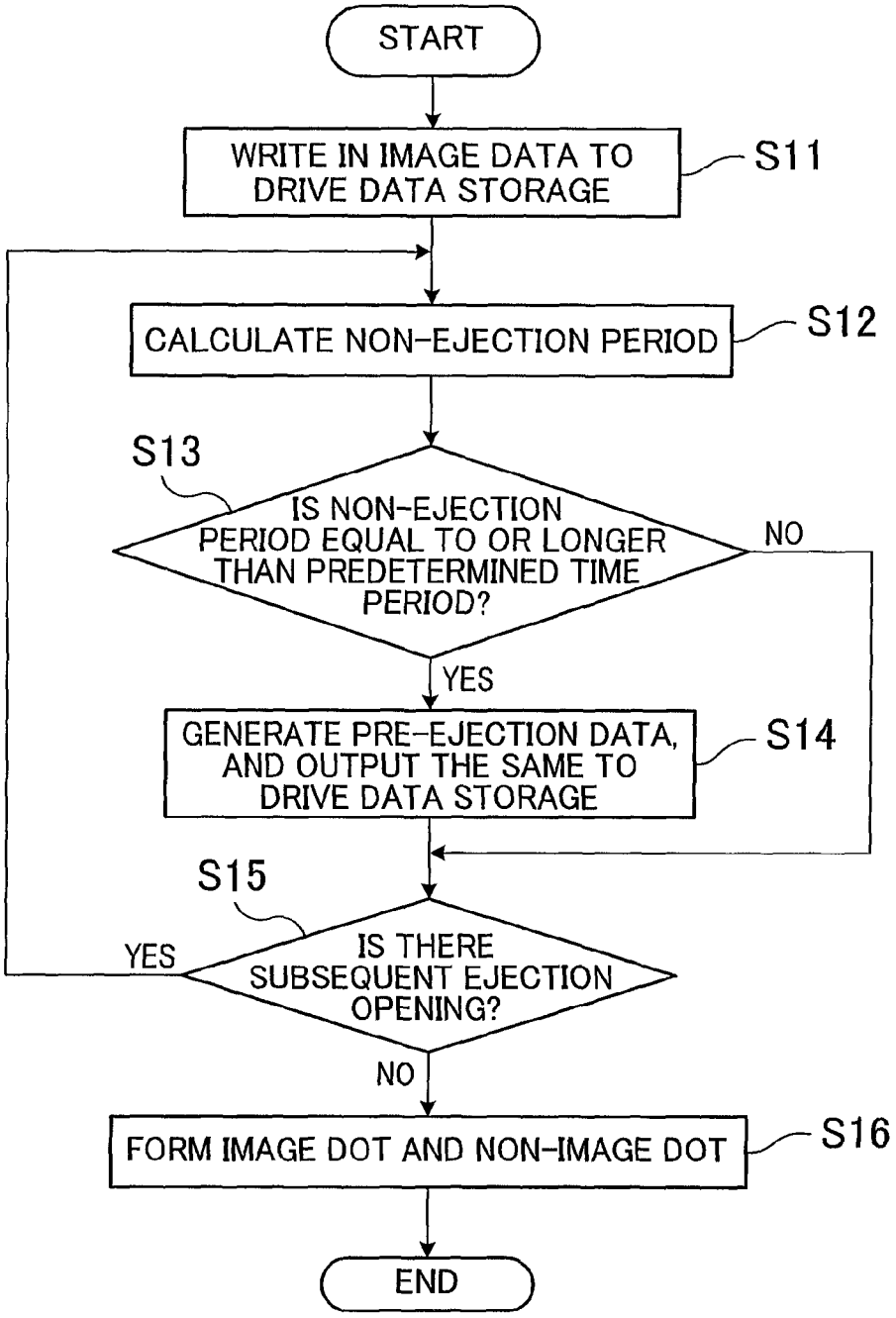
FIG. 13 is a flowchart showing an example of steps in a process performed by the control device of FIG. 11.

Next, the following describes with reference to FIG. 13, processing steps of the image forming operation executed by the control device 16 of the second embodiment. Note that the image data is given from the outside and stored in the image data storage 162 before the processing steps are executed. The process of FIG. 13 is started thereafter.

First, the data writing unit 163 writes the image data stored in the image data storage 162 to the drive data storage 165 (S11). Next, the determiner 155 calculates a non-ejection period for one ejection opening 108, based on the image data stored in the image data storage 162 (S12).

In S13, there is determined whether or not the non-ejection period calculated out in S12 is equal to or longer than the predetermined time period T. When it is determined that the non-ejection period is shorter than the predetermined time period T, the process proceeds to S15. When the non-ejection period is determined as to be equal to or longer than the predetermined time period T, the process proceeds to S14.

In S14, the pre-ejection data generator 150 generates the above-mentioned pre-ejection data in relation to the ejection opening 108 whose non-ejection period is determined as to be equal to or longer than the predetermined time period T, and outputs the data to the drive data storage 165. The process shifts to S15 thereafter.

In S15, there is determined whether there is a subsequent ejection opening 108 for which the pre-ejection data may be generated. If there is an ejection opening 108 (S15: YES), the process returns to S12. For all the ejection openings 108, the pre-ejection data corresponding to the non-ejection period is successively generated, and stored in the drive data storage 165. If there is no subsequent ejection opening 108 (S15: NO), the process shifts to S16.

In S16, the driver 166 controls driving of the actuators of the heads 1, based on drive data stored in the drive data storage 165. When the drive data at this time is based only on the image data, only the image dots 81 are formed on the sheet P. On the other hand, when the drive data is based on the image data and the pre-ejection data, image dots 81 based on the image data are formed on the sheet P, and non-image dots 82 corresponding to the image dots 81 are formed in the blank area 90.

For example, suppose that based on the image data, twelve image dots 81 are to be formed side by side in the sub scanning direction at a time point (first time point) as shown in FIG. 12, and subsequent image dots 81 to these twelve image dots 81 are to be formed in the main scanning direction, after the predetermined time period T. In this case, a linear image 80 (array of image dots 81) extending in the sub scanning direction is formed at the first time point, according to the drive data generated as described above. Then, a belt-shaped blank area 90 extending in the conveyance direction is formed subsequently to the linear image 80. This blank area 90 includes the distribution area 91, and the non-image dots 82 are formed in this area. At this time, for each ejection opening 108 related to the formation of the linear image, one non-image dot 82 is formed within the distribution area 91, at a predetermined distribution probability. Thus, an image is formed on the sheet P, and the image forming operation is completed.

In the second embodiment described above, in the non-ejection period, the shorter the period elapsed from the first time point, the smaller the probability of forming the non-image dot 82 becomes. In the present embodiment, the size of the ink droplet of the non-image dot 82 is constant. As such, the shorter the period elapsed from the first time point, the smaller the amount of ink ejected from the ejection opening 108 to the corresponding area. Suppose that the probability of forming the non-image dot 82 is higher or the amount of ink to be ejected from the ejection openings 108 is large, at a time point of the non-ejection period shortly after the first time point. The non-image dot 82 is noticeable particularly in the vicinity of the image 80. With the present embodiment however, the non-image dot 82 is hardly noticeable, particularly in the vicinity of the image 80. Therefore, the present embodiment allows formation of the non-image dot 82 while restraining deterioration of the quality of the image 80.

Further, the pre-ejection data generator 150 generates the pre-ejection data so that the number of non-image dots 82 in the anterior area 92 is reduced; i.e., the amount of ink to be placed on the sheet P is reduced, towards the posterior end of the image 80. The number of non-image dots 82 to be placed; i.e., the amount of ink to be placed is the smallest in the divisional area 93*a* among the divisional areas 93*a* to 93*c*. In the distribution area 91, the positions of the non-image dots 82 are randomly scattered. With the above structure, the non-image dots 82 formed on the anterior area 92 are made hardly noticeable, through a simple control.

Further, the positions of the non-image dots 82 are irregularly scattered, based on random numbers. Therefore, the positions of the non-image dots 82 in the divisional areas 93*a* to 93*c* are suitably scattered. This lowers the visibility of the non-image dots 82.

The second embodiment may be modified so that the pre-ejection area determiner 253 varies for each area the size of the ink droplets of pre-ejection, in addition to determining the pre-ejection timings for each of the ejection openings 108. In this modification, the pre-ejection area determiner 253 determines the size of the ink droplets so that the diameter of the non-image dots 82 is reduced towards the posterior end of the image 80. Since the number of non-image dots 82 in each of the divisional areas 93*a* to 93*c* is the same as the second embodiment, the amount of ink to be placed in the divisional area 93*a* is the smallest among the divisional areas 93*a* to 93*c*. The above modification also brings about the same effects brought about by the second embodiment. This modification further enables formation of hardly noticeable non-image dots 82 in the anterior area 92 through simple control. Further, in the divisional area 93*a* which is closest to the image 80 among the divisional areas 93*a* to 93*c*, the amount of ink for one non-image dot 82 is reduced. Therefore, the concentration difference becomes significant between the image 80 and an area nearby the image. This improves the quality of image 80.

Another modification of the second embodiment is as follows. Namely, when the length of the anterior area 92 is shorter than the predetermined length; e.g., the anterior area 90 corresponds to two divisional areas 93*a* and 93*b*, the pre-ejection area determiner 253 adjusts the number and the dot size of the non-image dots 82 to reduce the amount of ink to be placed in the divisional area 93*a*. In addition to this, the pre-ejection area determiner 253 make the amount of ink to be placed in the divisional area 93*c* smaller than the amount of ink to be placed in the divisional area 93*b*. At this time, the pre-ejection area determiner 253 reduces at least one of the number and size of the non-image dots 82, in relation to the divisional area 93*c*. In this case too, one of the two divisional areas 93*a* and 93*b* closer to the posterior end of the image 80 is given the smaller probability of forming the non-image dots 82 and the amount of ink to be ejected to the sheet P is thus made smaller as compared with the other one. Thus, this modification also brings about the same effects brought about by the second embodiment. Suppose the amount of ink to be placed on the divisional area 93*a* is less than the ink placed in the divisional area 93*b*. In this case, for example, the number of non-image dots 82 in the divisional area 93*a* may be more than the number of non-image dots 82 formed in the divisional area 93*b*. However, in this case, the size of ink droplets of the non-image dots 82 in the divisional area 93*a* is smaller than the size of those for the non-image dots 82 in the divisional area 93*b*. This modification also brings about the same effect brought about by the second embodiment.

Figure 14:
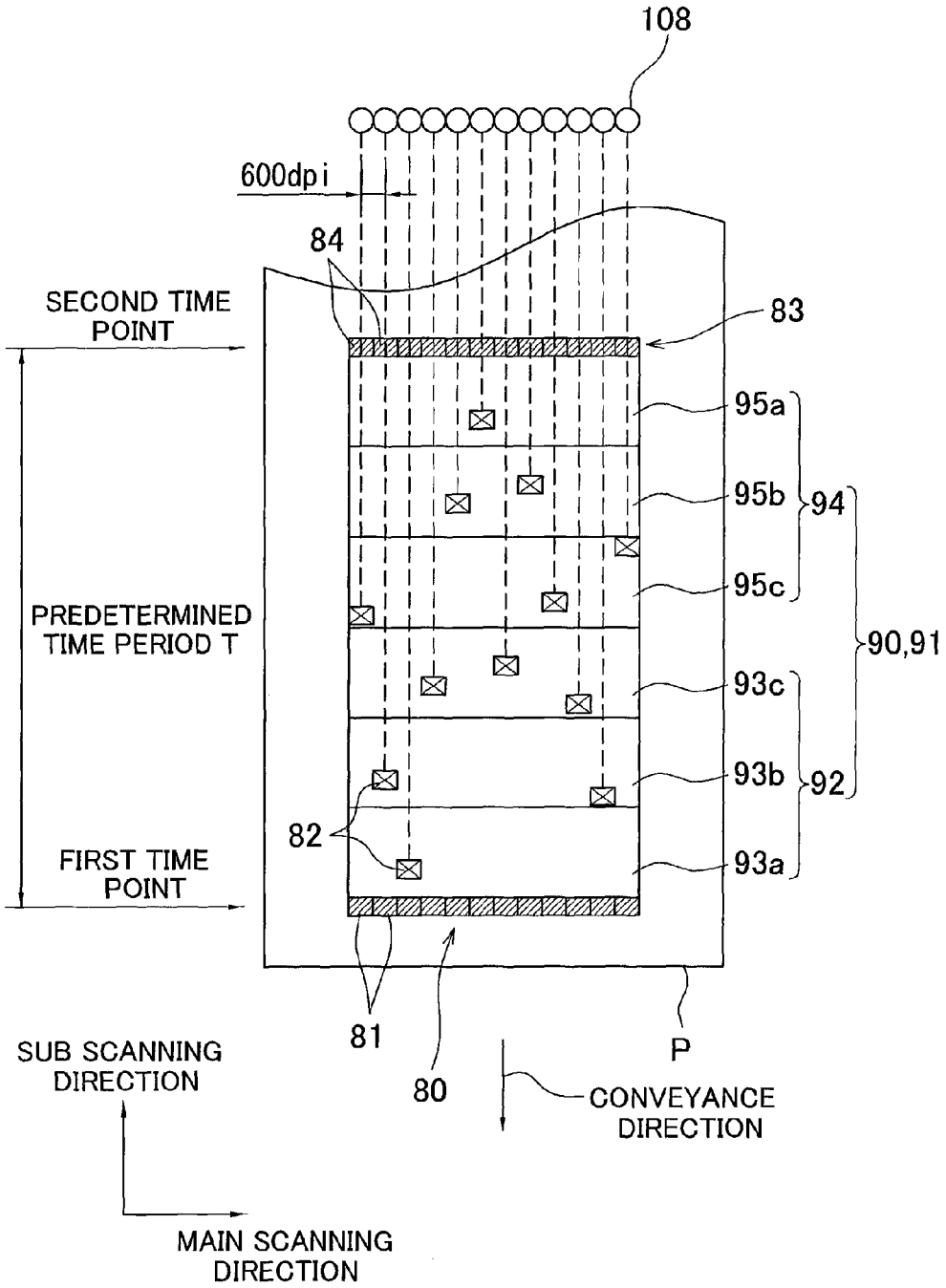
FIG. 14 shows an alternative form of the ink-jet printer related to the second embodiment of the present invention, and is an explanatory diagram of pre-ejection data created by the pre-ejection data generator.

Yet another modification of the second embodiment is as follows. As shown in FIG. 14, the blank area 90 is sandwiched by two images 80 and 83 which are apart from each other by a predetermined length in the conveyance direction. The length of the anterior area 92 is shorter than the predetermined length. From the posterior end of the anterior area 92 to the position immediately before the anterior end of the image 83, a posterior area 94 is extended. The pre-ejection data generator 150 generates pre-ejection data such that at least one of the number and the size of non-image dots 82 is adjusted so that the total ink amount for the non-image dots 82 in the posterior area 94 is reduced from the anterior area 92 towards the image 83. The length of the anterior area 92 in the conveyance direction is the same as that of the posterior area 94 in this modification. However, the lengths of these areas may be different.

For example, as shown in FIG. 14, the area divider 251 divides the posterior area 94 into three divisional areas 95*a* to 95*c*, in addition to dividing the anterior area 92 into divisional areas 93*a* to 93*c*. The divisional areas 95*a* to 95*c* have the same length relative to the conveyance direction.

The pre-ejection area determiner 253 determines, for each ejection opening 108 related to the blank area 90, which one of the divisional areas 93*a* to 93*c*, and 95*a* to 95*c* one pre-ejection will be performed. At this time, the pre-ejection area determiner 253 assigns the ejection openings 108 to the divisional areas so that, in the anterior area 92, the number of non-image dots 82 is reduced towards the posterior end of the image 80, and in the posterior area 94, the number of non-image dots 82 is reduced towards the image 83. Specifically, the pre-ejection area determiner 253 of this modification assigns one ejection opening 108 to each of the divisional areas 93*a* and 95*a*, two ejection openings 108 to each of the divisional areas 93*b* and 95*b*, and three ejection openings 108 to each of the divisional areas 93*c* and 95*c*. Needless to say that the pre-ejection area determiner 253 sets the placement positions of the non-image dots 82 based on random numbers in each area. That is, the probability of ejecting ink droplets from the ejection openings 108 to the anterior area 92 and the posterior area 94 is reduced towards the images 80 and 83, respectively. At this time, the total ink amount of the non-image dots 82 formed in each of the divisional areas 93*a* and 95*a* is less than those of the other divisional areas 93*b*, 93*c*, 95*b*, and 95*c*.

As described, although the blank area 90 is sandwiched between two images 80 and 83, the probability of forming the non-image dots 82 is reduced towards the images 80 and 83. In other words, the number of non-image dots 82 is reduced towards the images 80 and 83. Since the size of the non-image dot 82 is constant, the amount of ink to be placed on the sheet P is reduced towards the images 80 and 83. Thus, the non-image dots 82 are randomly scattered, and an area with a high density of non-image dots 82 is farther apart from the images 80 and 83 as compared with an area with a lower density of the non-image dots 82. This realizes a larger concentration difference between the images 80 and 83 and areas nearby the images 80 and 83, while keeping a low visibility of the non-image dots 82 in general. That is, high quality images 80 and 83 are obtained.

Note that, in the first embodiment, non-formation of image dot in image data is counted in increments of 1 pixel. However, the method of counting may be modified in various ways. For example, when the image data is compressed and one unit data contains information for pixels, the counting may be performed in increments of pixels.

Further, in the first embodiment, after the timing for forming a non-image dot is determined, the determiner 155 resumes reference to the corresponding data unit immediately after the timing. However, the determiner 155 may resume reference to any data unit, provided that the data unit corresponds to a time point between the timing for forming the non-image dot and the second time point.

Each of the above described embodiments deal with a case where the non-image dots are scattered based on random numbers generated by the random number generators 152 and 252. However, the non-image dots may be scattered by a method other than the method of using random numbers, as long as the non-image dots are hardly noticeable. For example, the non-image dots may be positioned in a regular pattern, instead of an irregular pattern, as long as the non-image dots are hardly noticeable. Further, the positions of the non-image dots may be calculated by using a formula or a pattern or the like which is set in advance. The first embodiment may be adapted so that, when the pre-ejection data generator 150 temporarily sets the positions of the non-image dots at positions corresponding to a constant period away from the first time point and the positions of the non-image dots in relation to ejection openings 108 are aligned in a transverse direction, the position of a non-image dot of any one of the ejection openings 108 is shifted. Further, in the second embodiment, the scattering pattern is an arrangement pattern of the non-image dots in a virtual basic area. The basic area has the same width as the divisional area in the conveyance direction, and has non-image dots positioned at equal intervals in the main scanning direction, without overlapping one another. In the basic area, the non-image dots are arranged in a random pattern which is set in advance. When arranging the non-image dots in the designated divisional area, the pre-ejection area determiner 253 refers to the non-image dots in the scattering pattern, successively in the main scanning direction, and sets them in actual placement positions.

The present invention is applicable not only to a printer, but also to any given liquid ejection apparatus such as facsimile, photocopier, and the like. Further, the number of heads in the liquid ejection apparatus is not limited to four, and the number of heads may be any given number of one or more. The head is not limited to a line type, and may be a serial type. Further, the head may eject any given liquid other than ink or a precoat liquid.

The recording medium is not limited to a sheet P, and may be various type of recording medium. The method of ejection is not limited. The above embodiments deal with a case of piezoelectric element as an example; however, a resistance heating method, an electrostatic capacitance method, or the like may be adopted as the ejection method.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus, comprising:

a head which has a plurality of ejection openings for ejecting liquid, the ejection openings being arranged at equal intervals relative to one direction, wherein the head includes a first head which ejects a first liquid, and a second head positioned upstream of the first head relative to a conveyance direction, which ejects a second liquid containing a component aggregated or precipitated by the first liquid;

a conveyor which conveys a recording medium relatively to the head, in the conveyance direction intersecting the one direction;

an image dot controller which controls the head based on image data so that the liquid is ejected from the ejection openings to form image dots structuring pixels of an image on the recording medium conveyed by the conveyor;

a determiner which successively determines, for each of the ejection openings, whether an image dot non-forming period is equal to or longer than a predetermined time period, the image dot non-forming period being a period from a first time point where an image dot is formed to another time point where a subsequent image dot is formed under control by the image dot controller; and a non-image ejection data generator which generates non-image ejection data for non-image dot formation, wherein the non-image ejection data generator is configured to set a non-image dot forming period for each ejection opening for which the determiner determined that the image dot non-forming period is equal to or longer than the predetermined time period, the non-image dot forming period being a period within which a single non-image dot is to be formed by the respective ejection opening, and the non-image dot forming period being a period from a third time point which is after the first time point to a second time point which is the predetermined time period after the first time point, and wherein the non-image ejection data generator is configured to determine an ejection time within the non-image dot forming period for the respective ejection opening, the ejection time being a time at which the respective ejection opening is to form the single non-image dot, wherein the non-image ejection data generator is configured to determine whether the ejection time for a first ejection opening of the first head and the ejection time for a second ejection opening of the second head are such that the respective ejection times would cause the second ejection opening to eject the second liquid onto the single non-image dot formed by the first ejection opening, the first ejection opening and the second ejection opening being aligned in the conveyance direction, wherein the non-image ejection data generator is configured to adjust one or more of the ejection time for the first ejection opening and the ejection time for the second ejection opening in response to determining that the respective ejection times would cause the second ejection opening to eject the second liquid onto the single non-image dot formed by the first ejection opening such that, after adjusting the one or more of the ejection time for the first ejection opening and the ejection time for the second ejection opening, the respective ejection times would not cause the second ejection opening to eject the second liquid onto the single non-image dot formed by the first ejection opening, and wherein the non-image ejection data generator is configured to generate the non-image ejection data for each of the ejection openings, the non-image ejection data including the ejection time for the respective ejection opening as adjusted; and a non-image dot controller which controls the head so that each of the ejection openings ejects, based on the non-image ejection data for the respective ejection opening, the liquid once within the non-image dot forming period in the image dot non-forming period for the respective ejection opening to form on the recording medium the non-image dot, which is not based on the image data, so that a plurality of the non-image dots structured by the liquid ejected from the ejection openings are scattered in the conveyance direction.

2. The liquid ejection apparatus according to claim 1, wherein:

the determiner includes a counter which, while referring to data units in the image data successively in a direction corresponding to the conveyance direction, counts up the number of pixels where no image dot is formed and resets the count at a pixel where an image dot is to be formed; and the determiner determines that the image dot non-forming period is equal to or longer than the predetermined time period, when the count reaches n (where n is a natural number of 2 or higher).

3. The liquid ejection apparatus according to claim 2, wherein the non-image ejection data generator sets as the non-image dot forming period a part of the image dot non-forming period, which ranges from a time point where the count reaches n to a time point where the count is n-m+1 (where m is a natural number smaller than n), when the determiner determines that the image dot non-forming period is equal to or longer than the predetermined time period.

4. The liquid ejection apparatus according to claim 2, wherein the counter resets the count when the count reaches n, and starts referring to the data units in the image data from a data unit corresponding to a time point after the time point which is within the non-image dot forming period and where the non-image dot is formed.

5. The liquid ejection apparatus according to claim 1, further comprising a data converter which converts an image data unit corresponding to the time point of forming the non-image dot to a data unit instructing the non-image dot controller to form the non-image dot, wherein the non-image dot controller forms the non-image dot based on the data unit converted by the data converter.

6. The liquid ejection apparatus according to claim 1, further comprising a random number generator, wherein the non-image ejection data generator determines the ejection time for forming the non-image dot, based on a random number generated by the random number generator.

7. The liquid ejection apparatus according to claim 1, further comprising a sensor for measuring at least one of the temperature and the humidity, wherein the non-image ejection data generator sets the length of the non-image dot forming period based on a result of measurement by the sensor.

8. The liquid ejection apparatus according to claim 1, wherein the non-image ejection data generator sets the length of the predetermined time period based on the type of liquid ejected from the ejection opening.

9. The liquid ejection apparatus according to claim 1, wherein the second liquid is transparent; and wherein the non-image ejection data generator sets the length of the non-image dot forming period so that the non-image dot forming period related to the second head is shorter than the non-image dot forming period related to the first head.

10. The liquid ejection apparatus according to claim 1, wherein the head is structured to eject droplets of different sizes; and wherein the non-image dot controller controls the head to form the non-image dot with droplets of the smallest size out of the different sizes.

11. The liquid ejection apparatus according to claim 1, wherein the head includes a plurality of head units which eject liquid of different types from each other; and wherein at least one of the predetermined time period and the non-image dot forming period is different between the head units.

12. A liquid ejection apparatus, comprising:

a head which has a plurality of ejection openings for ejecting liquid, the ejection openings being arranged at equal intervals relative to one direction, wherein the head includes a first head which ejects a first liquid, and a second head positioned upstream of the first head relative to a conveyance direction, which ejects a second liquid containing a component aggregated or precipitated by the first liquid;

a conveyor which conveys a recording medium relatively to the head, in the conveyance direction intersecting the one direction;

an image dot controller which controls the head based on image data so that the liquid is ejected from the ejection openings to form image dots structuring pixels of an image on the recording medium conveyed by the conveyor;

a determiner which successively determines, for each of the ejection openings, whether an image dot non-forming period is equal to or longer than a predetermined time period, the image dot non-forming period being a period from a first time point where an image dot is formed to another time point where a subsequent image dot is formed under control by the image dot controller;

a non-image ejection data generator which generates non-image ejection data for non-image dot formation, wherein the non-image ejection data generator is configured to set a non-image dot forming period for each ejection opening for which the determiner determined that the image dot non-forming period is equal to or longer than the predetermined time period, the non-image dot forming period being a period within which a single non-image dot is to be formed by the respective ejection opening, and the non-image dot forming period being a period from a third time point which is after the first time point to a second time point which is the predetermined time period after the first time point, wherein the non-image ejection data generator is configured to determine an ejection time within the non-image dot forming period for the respective ejection opening, the ejection time being a time at which the respective ejection opening is to form the single non-image dot, wherein the non-image ejection data generator is configured to determine whether the ejection time for a first ejection opening of the first head and the ejection time for a second ejection opening of the second head are such that the respective ejection times would cause the second ejection opening to eject the second liquid onto the single non-image dot formed by the first ejection opening, the first ejection opening and the second ejection opening being aligned in the conveyance direction, wherein the non-image ejection data generator is configured to adjust one or more of the ejection time for the first ejection opening and the ejection time for the second ejection opening in response to determining that the respective ejection times would cause the second ejection opening to eject the second liquid onto the single non-image dot formed by the first ejection opening such that, after adjusting the one or more of the ejection time for the first ejection opening and the ejection time for the second ejection opening, the respective ejection times would not cause the second ejection opening to eject the second liquid onto the single non-image dot formed by the first ejection opening, wherein the non-image ejection data generator is configured to generate the non-image ejection data for each of the ejection openings, the non-image ejection data including the ejection time for the respective ejection opening as adjusted, and wherein the determiner successively determines, for each of the ejection openings, whether a non-ejection period is equal to or longer than another predetermined time period, the non-ejection period being a period from a fourth time point where the liquid is ejected from the ejection opening to another time point where subsequent ejection of the liquid from the ejection opening occurs under control by the image dot controller; and a non-image dot controller which controls the head so that each of the ejection openings, whose non-ejection period is equal to or longer than the other predetermined time period, ejects the liquid once within another time period ranging from the fourth time point to a fifth time point which is the other predetermined time period after the fourth time point, the other time period being in a beginning section subsequent to the fourth time point in the non-ejection period, wherein the non-image dot controller controls the head such that, for each ejection opening, a probability of ejecting liquid from the ejection opening is controlled to be a lesser value when a length of the period elapsed from the fourth time point is a first length than when the length of the period elapsed from the fourth time point is a second length greater than the first length, and wherein the non-image dot controller controls the head so that each of the ejection openings ejects, based on the non-image ejection data for the respective ejection opening, the liquid once within the non-image dot forming period in the image dot non-forming period for the respective ejection opening to form on the recording medium the non-image dot, which is not based on the image data, so that a plurality of the non-image dots structured by the liquid ejected from the ejection openings are scattered in the conveyance direction.

13. The liquid ejection apparatus according to claim 12, wherein the non-image dot controller controls the head so that, when the recording medium has a belt-shaped blank area adjacent to a posterior end of an image formed on the recording medium by the liquid ejected from two or more of the ejection openings under control of the image dot controller, the blank area having a length longer than a predetermined length corresponding to the other predetermined time period and having no image formed therein under control by the image dot controller, the amount of liquid placed on the recording medium within an anterior area is reduced towards the posterior end of the image, the anterior area being a part of area ranging from an anterior end of the blank area subsequent to the posterior end of the image to a point which is a predetermined length away from the anterior end, the part including the anterior end of the blank area.

14. The liquid ejection apparatus according to claim 13, wherein the non-image dot controller controls the head so that, where the anterior area is divided into a plurality of divisional areas aligned in the conveyance direction, the amount of liquid to be placed is the smallest in one of the divisional areas closest to the posterior end of the image.

15. The liquid ejection apparatus according to claim 14, wherein the non-image dot controller controls the head so that the number of the non-image dots formed is the smallest in one of the divisional areas closest to the posterior end of the image.

16. The liquid ejection apparatus according to claim 14, wherein the non-image dot controller controls the head so that the diameter of the non-image dots is the smallest in one of the divisional areas closest to the posterior end of the image.

17. The liquid ejection apparatus according to claim 14, wherein the non-image dot controller controls the head based on a random number so that the positions of the non-image dots formed in the divisional areas are irregularly distributed.

18. The liquid ejection apparatus according to claim 13, wherein:

the length of the anterior area is shorter than the predetermined length;

the blank area is sandwiched between two images in the conveyance direction, the two images formed on the recording medium apart from each other by the predetermined length under control of the image dot controller; and the non-image dot controller controls the head so that, within an area ranging from a point immediately after a posterior end of the anterior area of the blank area to an anterior end of one of the two images formed later, at least one of the probability of ejecting the liquid from the ejection opening and the amount of liquid to be placed on the recording medium is reduced towards the one of the two images formed later.

19. The liquid ejection apparatus according to claim 12, wherein the length of the beginning section is equal to the predetermined time period.

20. A liquid ejection apparatus, comprising:

a head which has a plurality of ejection openings for ejecting liquid, the ejection openings being arranged at equal intervals relative to one direction, wherein the head includes a first head which ejects a first liquid, and a second head positioned upstream of the first head relative to a conveyance direction, which ejects a second liquid containing a component aggregated or precipitated by the first liquid;

a conveyor which conveys a recording medium relatively to the head, in the conveyance direction intersecting the one direction;

an image dot controller which controls the head based on image data so that the liquid is ejected from the ejection openings to form image dots structuring pixels of an image on the recording medium conveyed by the conveyor;

a determiner which successively determines, for each of the ejection openings, whether an image dot non-forming period is equal to or longer than a predetermined time period, the image dot non-forming period being a period from a first time point where an image dot is formed to another time point where a subsequent image dot is formed under control by the image dot controller;

a non-image ejection data generator which generates non-image ejection data for non-image dot formation, wherein the non-image ejection data generator is configured to set a non-image dot forming period for each ejection opening for which the determiner determined that the image dot non-forming period is equal to or longer than the predetermined time period, the non-image dot forming period being a period within which a single non-image dot is to be formed by the respective ejection opening, and the non-image dot forming period being a period from a third time point which is after the first time point to a second time point which is the predetermined time period after the first time point, wherein the non-image ejection data generator is configured to determine an ejection time within the non-image dot forming period for the respective ejection opening, the ejection time being a time at which the respective ejection opening is to form the single non-image dot, wherein the non-image ejection data generator is configured to determine whether the ejection time for a first ejection opening of the first head and the ejection time for a second ejection opening of the second head are such that the respective ejection times would cause the second ejection opening to eject the second liquid onto the single non-image dot formed by the first ejection opening, the first ejection opening and the second ejection opening being aligned in the conveyance direction, wherein the non-image ejection data generator is configured to adjust one or more of the ejection time for the first ejection opening and the ejection time for the second ejection opening in response to determining that the respective ejection times would cause the second ejection opening to eject the second liquid onto the single non-image dot formed by the first ejection opening such that, after adjusting the one or more of the ejection time for the first ejection opening and the ejection time for the second ejection opening, the respective ejection times would not cause the second ejection opening to eject the second liquid onto the single non-image dot formed by the first ejection opening, wherein the non-image ejection data generator is configured to generate the non-image ejection data for each of the ejection openings, the non-image ejection data including the ejection time for the respective ejection opening as adjusted, and wherein the determiner successively determines, for each of the ejection openings, whether a non-ejection period is equal to or longer than another predetermined time period, the non-ejection period being a period from a fourth time point where the liquid is ejected from the ejection opening to another time point where subsequent ejection of the liquid from the ejection opening occurs under control by the image dot controller; and a non-image dot controller which controls the head so that each of the ejection openings, whose non-ejection period is equal to or longer than the other predetermined time period, ejects the liquid once within another time period ranging from the fourth time point to a fifth time point which is the other predetermined time period after the first time point, the other time period being in a beginning section subsequent to the fourth time point in the non-ejection period, wherein the non-image dot controller controls the head such that, for each ejection opening, an amount of liquid ejected from the ejection opening in the one ejection within the other time period ranging from the fourth time point to the fifth time point is positively correlated with a length of the period elapsed from the fourth time point, whereby the amount of liquid ejected from the ejection opening in the one ejection is a lesser amount when the length of the period elapsed from the fourth time point is a first length than when the length of the period elapsed from the fourth time point is a second length that is greater than the first length, and wherein the non-image dot controller controls the head so that each of the ejection openings ejects, based on the non-image ejection data for the respective ejection opening, the liquid once within the non-image dot forming period in the image dot non-forming period for the respective ejection opening to form on the recording medium the non-image dot, which is not based on the image data, so that a plurality of the non-image dots structured by the liquid ejected from the ejection openings are scattered in the conveyance direction.

21. A liquid ejection apparatus, comprising:

a head which has a plurality of ejection openings for ejecting liquid, the ejection openings being arranged at equal intervals relative to one direction, wherein the head includes a first head which ejects a first liquid, and a second head positioned upstream of the first head relative to a conveyance direction, which ejects a second liquid containing a component aggregated or precipitated by the first liquid;

a conveyor which conveys a recording medium relatively to the head, in the conveyance direction intersecting the one direction;

an image dot controller which controls the head based on image data so that the liquid is ejected from the ejection openings to form image dots structuring pixels of an image on the recording medium conveyed by the conveyor;

a non-image dot controller which controls the head so that the liquid is ejected from the ejection openings to form a non-image dot, which is not based on the image data, on the recording medium conveyed by the conveyor; and a determiner which successively determines, for each of the ejection openings, whether an image dot non-forming period is equal to or longer than a predetermined time period, the image dot non-forming period being a period from a first time point where an image dot is formed to another time point where a subsequent image dot is formed under control by the image dot controller; and a non-image ejection data generator which generates non-image ejection data for non-image dot formation, wherein the non-image ejection data generator is configured to set a non-image dot forming period for each ejection opening for which the determiner determined that the image dot non-forming period is equal to or longer than the predetermined time period, the non-image dot forming period being a period within which a single non-image dot is to be formed by the respective ejection opening, and the non-image dot forming period being a period from a third time point which is after the first time point to a second time point which is the predetermined time period after the first time point, wherein the non-image ejection data generator is configured to determine an ejection time within the non-image dot forming period for the respective ejection opening, the ejection time being a time at which the respective ejection opening is to form the single non-image dot, wherein the non-image ejection data generator is configured to determine whether the ejection time for a first ejection opening of the first head and the ejection time for a second ejection opening of the second head are such that the respective ejection times would cause the second ejection opening to eject the second liquid onto the single non-image dot formed by the first ejection opening, the first ejection opening and the second ejection opening being aligned in the conveyance direction, wherein the non-image ejection data generator is configured to adjust one or more of the ejection time for the first ejection opening and the ejection time for the second ejection opening in response to determining that the respective ejection times would cause the second ejection opening to eject the second liquid onto the single non-image dot formed by the first ejection opening such that, after adjusting the one or more of the ejection time for the first ejection opening and the ejection time for the second ejection opening, the respective ejection times would not cause the second ejection opening to eject the second liquid onto the single non-image dot formed by the first ejection opening, wherein the non-image ejection data generator is configured to generate the non-image ejection data for each of the ejection openings, the non-image ejection data including the ejection time for the respective ejection opening as adjusted, and wherein the non-image dot controller controls the head so that each of the ejection openings, whose image dot non-forming period is equal to or longer than the predetermined time period, ejects the liquid once within a non-image dot forming period in the image dot non-forming period to form on the recording medium the non-image dot, the non-image dot forming period being a period from a third time point which is after the first time point to a second time point which is the predetermined time period after the first time point, and so that a plurality of the non-image dots structured by the liquid ejected from the ejection openings are scattered in the conveyance direction.

* * * * *